US012078155B2

(12) United States Patent
Soja

(10) Patent No.: US 12,078,155 B2
(45) Date of Patent: Sep. 3, 2024

(54) INDUCED FLOW DOUBLE DISC PUMP ASSEMBLY HAVING ROTATING ELEMENT

(71) Applicant: WASTECORP PUMPS INC., Toronto (CA)

(72) Inventor: Marc Johnson Soja, Toronto (CA)

(73) Assignee: WASTECORP PUMPS INC., Toronto (CA)

( * ) Notice: Subject to any disclaimer, the term of this patent is extended or adjusted under 35 U.S.C. 154(b) by 130 days.

(21) Appl. No.: 17/903,225

(22) Filed: Sep. 6, 2022

(65) Prior Publication Data

US 2024/0077067 A1 Mar. 7, 2024

(51) Int. Cl.
*F04B 1/02* (2006.01)
*F04B 53/10* (2006.01)

(52) U.S. Cl.
CPC ..... *F04B 1/02* (2013.01); *F04B 53/10* (2013.01)

(58) Field of Classification Search
CPC .. F04B 1/02; F04B 53/22; F04B 53/00; F04B 39/127; F04B 53/10; F04B 43/02; F04B 43/009; F16M 1/00; F16M 1/04
USPC ..... 269/59, 55; 29/281.1, 281.4; 248/671, 248/672; 74/606 R; 417/360, 361
See application file for complete search history.

(56) References Cited

U.S. PATENT DOCUMENTS 2,994,179 A * 8/1961 Van ..... A01D 78/148 56/377
4,473,339 A 9/1984 Hughs
4,570,320 A * 2/1986 Kile ..... F02B 77/00 29/271
5,617,622 A * 4/1997 Anderson ..... B25H 1/00 269/910
6,089,440 A * 7/2000 Brusha ..... B23K 37/04 269/61
6,315,532 B1 11/2001 Appleby
7,559,753 B2 7/2009 Burrage
2005/0062000 A1 * 3/2005 Bartell ..... F16K 15/063 251/82
2013/0174420 A1 * 7/2013 Chacon ..... B23Q 3/086 29/889.7
2020/0095990 A1 3/2020 Christian-Tabak

FOREIGN PATENT DOCUMENTS

GB 1399742 7/1975
GB 2013287 8/1979
GB 2099087 10/1982

* cited by examiner

*Primary Examiner* — Philip E Stimpert
*Assistant Examiner* — Dnyanesh G Kasture
(74) *Attorney, Agent, or Firm* — Edwin E. Voigt, II

(57) ABSTRACT

An induced flow reciprocating double disc pump assembly includes a rotating frame supporting a double disc pump, the rotating frame has a plurality of supports and a shaft defining a horizontal axis of rotation. A stationary frame supports the rotating frame and includes a plurality of bars and uprights and a flange bearing assembly engaged each of the shafts permitting rotation between the rotating frame and the stationary frame. A locking pin positions the rotating frame and the stationary frame at a plurality of positions relative to each other. A rotation crank is engaged to the shaft. The rotating frame has a first position relative to the stationary frame supporting the double disc pump in a vertical direction and a second position where the double disc pump is in a horizontal direction.

17 Claims, 17 Drawing Sheets

INDUCED FLOW DOUBLE DISC PUMP ASSEMBLY HAVING ROTATING ELEMENT

FIELD OF THE INVENTION

This invention relates to induced flow self priming positive displacement double disc pumps designed to process waste water materials such as municipal waste water, industrial sludge's and food-processing waste for example.

BACKGROUND

An induced flow reciprocating double disc pump may be used to pump sludge from one tank to another. The induced flow reciprocating double disc pump may also be used to feed sludge to a belt filter press or centrifuge. An induced flow reciprocating double disc pump includes a reciprocating crankshaft which is affixed to connecting rods and discs which engage into, and out of, valve seats to transmit fluid through the pump in a positive displacement reciprocating manor.

Examples of an induced flow reciprocating double disc pump may be found in G.B. Application No. GB 30333/72 (C. Hughes, filed Sep. 27, 1972), U.S. Pat. No. 4,473,339 (C. Hughes, issued Sep. 25, 1984).

The induced flow reciprocating double disc pumps as known are difficult to service where assembly or disassembly of components is problematic. During use, the discs and pump body of the induced flow reciprocating double disc pumps frequently encounter clearance issues which reduce performance and efficiency. Replacing the discs is an arduous and potentially dangerous process necessitating that the main body and intermediate body of the induced flow reciprocating double disc pumps to be dropped via a hinge, for example, and must be worked upon from the underside or beneath the pump as disclosed in U.S. Pat. No. 7,559,753 (L. J Burrage, issued Jul. 12, 2009) and U.S. Pat. No. 6,315,532 (D. Appleby, issued Nov. 13, 2001).

A failure to regularly service an induced flow reciprocating double disc pump may result in expensive replacement as a result of corrosion related seizures.

During use, an induced flow reciprocating double disc pump may ingest solid material which may cause damage or wear to the sealing surface of the swan neck elbow, or compromise operation, causing pump inversion or pump priming issues.

In addition, during the pumping of caustic or abrasive fluids, valve components, notably the valve seats, may become worn or damaged causing the valve seat to malfunction. Also, the cast face will wear quickly when pumping abrasive slurries causing clearance issues reducing performance and efficiency.

During use of the induced flow reciprocating double disc pump, abrasion wear will normally occur to the sealing surface of the intermediate housing and suction inlet housing seating surface.

In the past spray coatings have been applied to reduce wear of the induced flow reciprocating double disc pump. Examples of spray coatings include XYLAN® or High-Velocity Oxygen Fuel (HVOF) coatings and Tungsten Carbide coatings applied to adhere to the castings surface. However, coatings eventually wear-out or deteriorate over time resulting in the casting being deemed unusable necessitating replacement at substantial cost.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. § 1.56(a) exists.

All U.S. patents and applications and all other published documents mentioned anywhere in this application are incorporated herein by reference in their entirety.

Without limiting the scope of the invention, a brief description of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided for the purposes of complying with 37 C.F.R. § 1.72.

GENERAL DESCRIPTION OF THE INVENTION

The induced flow reciprocating double disc pump assembly includes a rotatably connected stationary frame element and a rotating frame element which during use may reposition the double disc pump super structure at a 90 degree rotation relative to each other. The repositioning of the double disc pump super structure simplifies the assembly, disassembly and service process. The rotating frame element improves safety to user, is relatively inexpensive to produce, has a smaller overall footprint, improves serviceability and is not prone to corrosion related seizures.

The stationary and rotating frame elements in some embodiments include uprights, diagonal bracing, cross bracing, a base frame, and rail conduits. The rail conduits may pivot relative to the upper end of each upright. The rail conduits are positioned on opposite sides of a common horizontal pivotal axis, centrally and longitudinally bisecting the double disc pump super structure as secured between each rail conduit. Flange bearings are used to rotate the stationary and rotating frame elements relative to each other.

In some embodiments, the flange bearings have a cylindrical inner body supporting the flange bearings and an outer flange exterior which may be square or another shape at the discretion of an individual.

In at least one embodiment, the outer flange exterior includes boles used to securely affix the flange bearings to the top of the uprights. The flange bearings are engaged to a shaft (or to one of a split pair of aligned shaft portions) of the rotating frame element. The rotating frame element in turn is securely attached to the double disc pump super structure, enabling the controlled rotation of the double disc pump super structure relative to stationary frame elements.

The rotating frame element includes structure which extends horizontally along the length of the double disc pump super structure. The horizontally extending structure of the rotating frame element at opposite ends is joined by perpendicular frame bars. Lugs and/or bolts and nuts may be used to secure the mantel block of the double disc pump super structure to the top flat face of the horizontally extending structure of the rail conduits. The lugs and/or bolts and nuts rigidly support and affix the double disc pump super structure to the rail conduits.

In some embodiments, a locking pin may be used in conjunction with the flange bearings and the rotating frame element in order to lock and hold the double disc pump super structure in one of multiple rotational positions relative to the stationary frame element. A hand crank or mechanical rotary winch may be used to rotate the double disc pump super structure and rotating frame element relative to the stationary frame element eliminating the need for hydraulic or electrical rotation devices.

In at least one embodiment the rotating frame element and the stationary frame element are formed of sufficiently strong and durable materials to not fracture or fail during use in the support and rotation of a double disc pump super structure.

In some embodiments, the induced flow reciprocating double disc pump assembly includes a replaceable and/or renewable enhanced sealing and reduced wear double disc pump flapper clack valve and seat.

In at least one alternative embodiment, the induced flow reciprocating double disc pump assembly includes a renewable valve seat for the sealing surface between the intermediate housing and suction inlet housing seating surface, reducing wear and eliminating the need for spray coating of the double disc pump super structure. The renewable valve seat may be formed of materials such as stainless steel or other durable or coated materials dependent on the type of product being pumped by the double disc pump.

In at least one alternative embodiment, the induced flow reciprocating double disc pump assembly includes guide rods which function to support, and to aid in the installation and removal of the inlet suction housing and intermediate housing from the double disc pump super structure. The guide rods act as slider rails to maintain alignment of the inlet suction housing and intermediate housing relative to the double disc pump super structure during assembly or disassembly. The guide rods prevent the inlet suction housing and intermediate housing from dropping relative to the double disc pump super structure upon release of the fasteners between the inlet suction housing and intermediate housing and the double disc pump super structure.

While the foregoing is a description of some of the embodiments for carrying out the invention for the purposes of complying with 37 C.F.R. 1.72., it is also intended in an illustrative rather than a restrictive sense. Variations to the exact embodiment described may be apparent to those skilled in such equipment without departing from the spirit and scope of the invention as defined by the claims set out below.

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

DETAILED DESCRIPTION OF THE PREFERRED EMBODIMENTS

Figure 1:
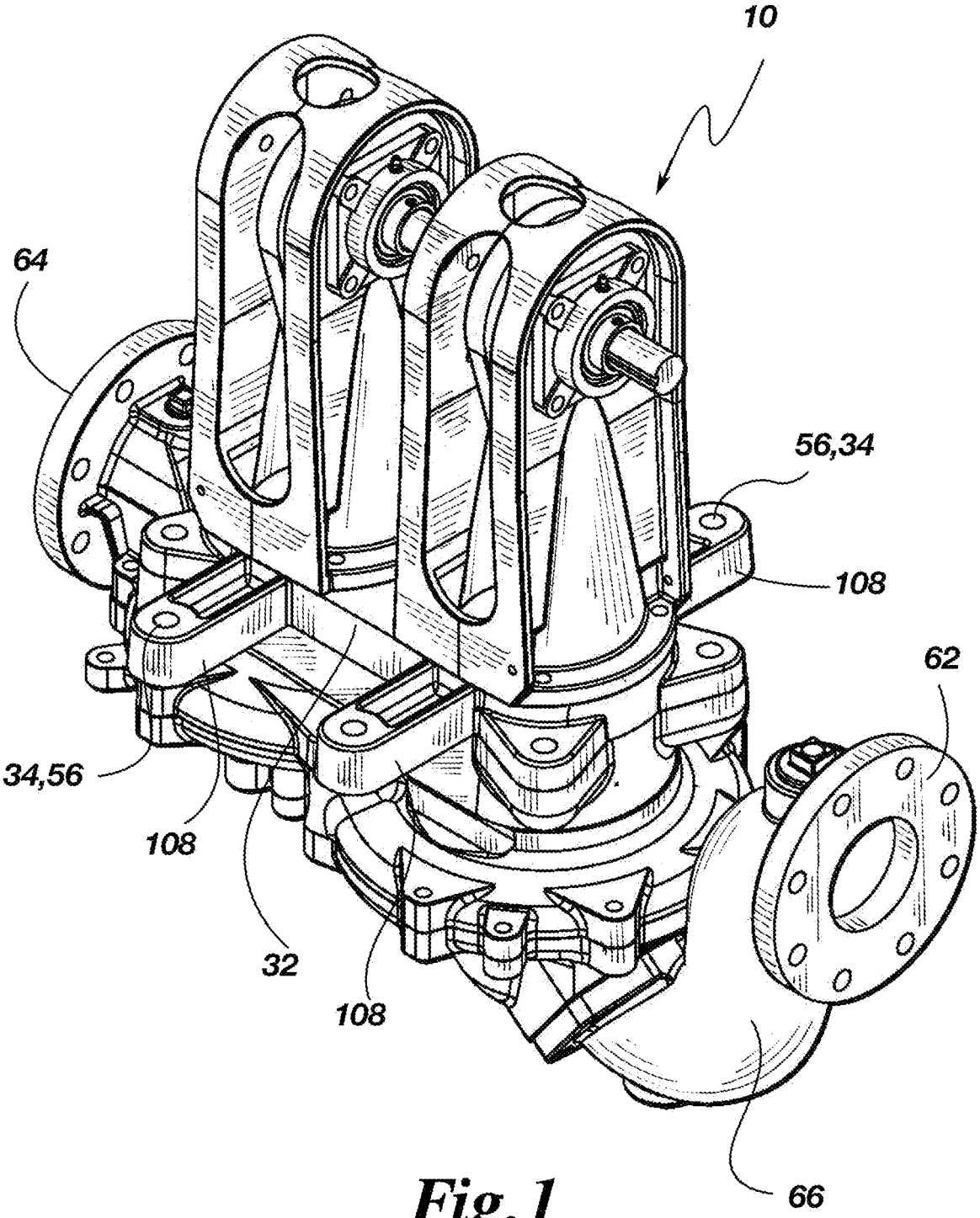
FIG. 1 is a detail perspective view of one alternative embodiment of a double disc pump super structure.

In general the induced flow reciprocating double disc pump assembly is referred to by reference numeral 8. The primary components of the induced flow reciprocating double disc pump assembly 8 are the double disc pump super structure 10, the stationary frame element 58 and the rotating frame element 60.

In one embodiment as my be seen in FIG. 1 the double disc pump super structure 10 includes a mantel block 32, block conduits 108, a suction coupler 62, and a discharge coupler 64. A swan neck elbow 66 may be integral or affixed to the suction coupler 62.

Figure 2:
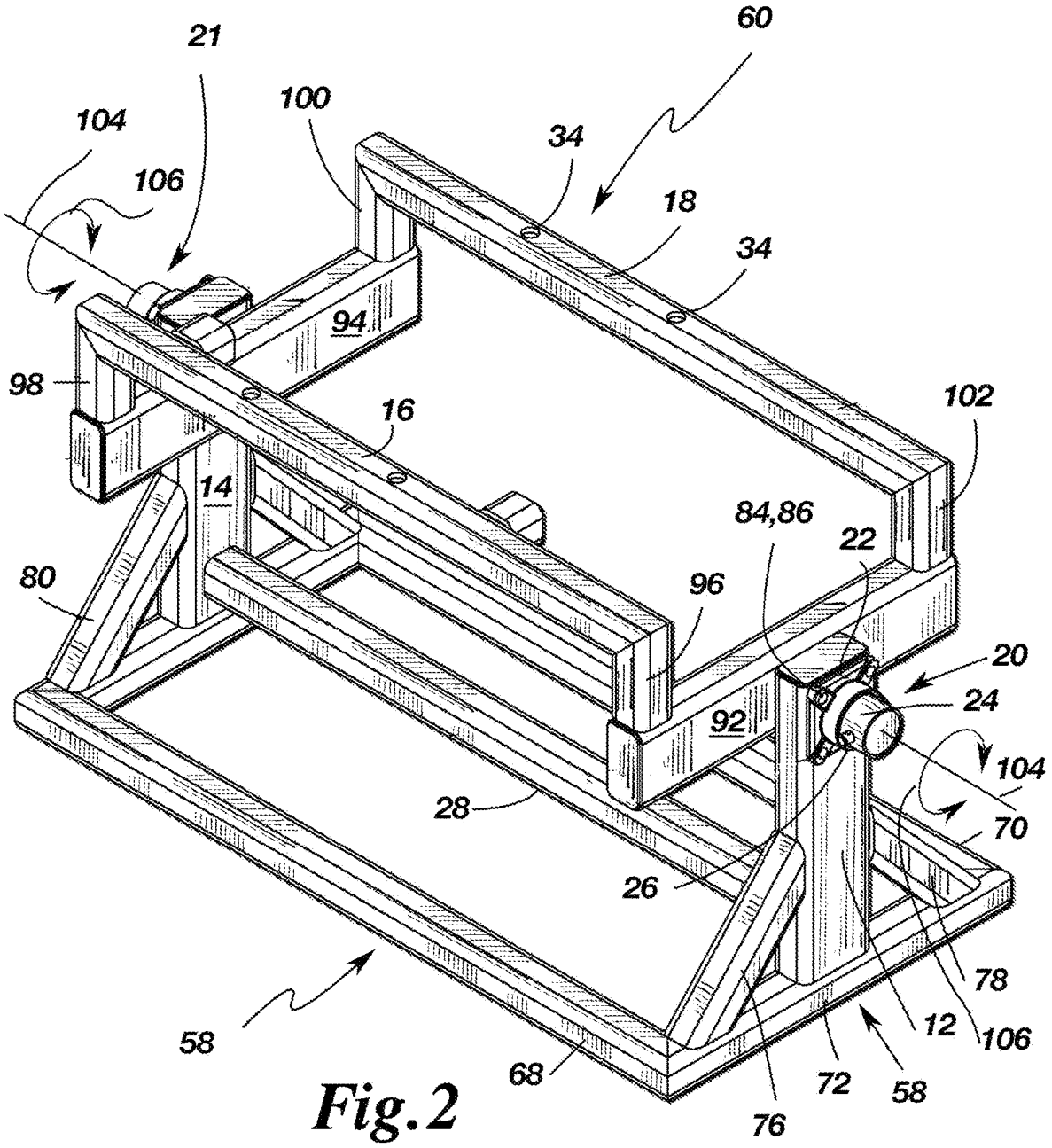
FIG. 2 is a detail perspective view of one alternative embodiment of the stationary and rotating frame elements of the induced flow reciprocating double disc pump assembly.

In at least one embodiment as may be seen in FIG. 2 the stationary frame element 58 is rotatably engaged to the rotating frame element 60. The stationary frame element 58 may be formed of an elongate first base frame bar 68 and an elongate second base frame bar 70, which is parallel to the first base frame bar 68. A third base frame bar 72 is preferably integral with and extends perpendicularly between first ends of the first base frame bar 68 and second base frame bar 70, and a fourth base frame bar 74 is preferably integral with and extends perpendicularly between second or opposite ends of the first base frame bar 68 and second base frame bar 70.

A first upright 12 is preferably centrally located on the top surface of the third base frame bar 72 extending perpendicularly and vertically upward therefrom. A second upright 14 is preferably centrally located on the top surface of the fourth base frame bar 74 extending perpendicularly and vertically upward therefrom. In some embodiments the first upright 12 and second upright 14 have increased dimensions as compared to the first base frame bar 68, second base frame bar 70, third base frame bar 72, and fourth base frame bar 74.

A first diagonal brace 76 is preferably integral with extends angularly and upwardly from the third base frame bar 72, proximate to the first base frame bar 68, for integral engagement to a side surface of the first upright 12.

A second diagonal brace 78 is preferably integral with extends angularly and upwardly from the third base frame bar 72, proximate to the second base frame bar 70, for integral engagement to an opposite side surface of the first upright 12.

A third diagonal brace 80 is preferably integral with extends angularly and upwardly from the fourth base frame bar 74, proximate to the first base frame bar 68, for engagement to a side surface of the second upright 14.

A fourth diagonal brace 82 is preferably integral with extends angularly and upwardly from the fourth base frame bar 74, proximate to the second base frame bar 70, for engagement to an opposite side surface of the second upright 14.

An elongate cross brace bar 28 extends between the interior of the first upright 12 and the interior of the second upright 14 proximate to the bottom or the third base frame bar 72 and fourth base frame bar 74.

The first base frame bar 68, second base frame bar 70, third base frame bar 72, fourth base frame bar 74, first diagonal brace 76, second diagonal brace 78, third diagonal brace 80, fourth diagonal brace 82, cross brace bar 28, first upright 12 and second upright 14 are sufficiently structurally strong to support the rotating frame element 60 and the double disc pump super structure 10 above a surface without fracture or failure during use in pumping of fluids and/or materials as identified herein.

The first base frame bar 68, second base frame bar 70, third base frame bar 72, fourth base frame bar 74, first diagonal brace 76, second diagonal brace 78, third diagonal brace 80, fourth diagonal brace 82, cross brace bar 28, first upright 12 and second upright 14 are also preferably formed of metallic material having sufficient strength and durability to support the rotating frame element 60 and the double disc pump super structure 10 without failure following prolonged periods of use and exposure to potentially corrosive liquids and/or the elements.

The first base frame bar 68, second base frame bar 70, third base frame bar 72, fourth base frame bar 74, first diagonal brace 76, second diagonal brace 78, third diagonal brace 80, fourth diagonal brace 82, cross brace bar 28, first upright 12 and second upright 14 are preferably connected to each respective structural component by mechanical fastening, such as by welding, however in alternative embodiments other types of mechanical fastening elements such as sufficiently strong bots and nuts may be used. The contact between adjacent structural elements may be a matching 45 degree angle or may be perpendicular dependent on the composition of the materials selected for the structural materials and the type of mechanical fastening to be used.

Continuing to refer to FIG. 2 the upper end of the first upright 12 includes a first flange bearing assembly 20 and the upper end of the second upright 14 includes a second flange bearing assembly 21. Each of the first flange bearing assembly 20 and the second flange bearing assembly 21 respectively includes an outer flange exterior 22 and a cylindrical inner body 24. The outer flange exterior 22 may be formed of metallic material and is used to couple the first and second flange bearing assemblies 20, 21 to the exterior surface of the respective first and second uprights 12, 14. Pairs of aligned coupling holes 82 in the first and second flange bearing assemblies 20, 21 and the outer flange exteriors 22 may receive coupling fasteners 86 to releasable secure the first and second flange bearing assemblies 20, 21 to the respective first and second uprights 12, 14. Replacement of worn first and second flange bearing assemblies 20, 21 may thereby be facilitated.

The cylindrical inner body 24 may be formed of sufficiently sturdy metallic material to provide support to an axis element or shaft 88 as disposed within the interior of the first flange bearing assembly 20 and the second flange bearing assembly 21. The shaft 88 may be split into aligned shaft portions to avoid contact with the underside of the double disc pump super structure 10. The first flange bearing assembly 20 and the second flange bearing assembly 21 facilitate and enable the ease of rotation of the axis element or shaft 88 relative to stationary frame element 58.

Figure 19A:
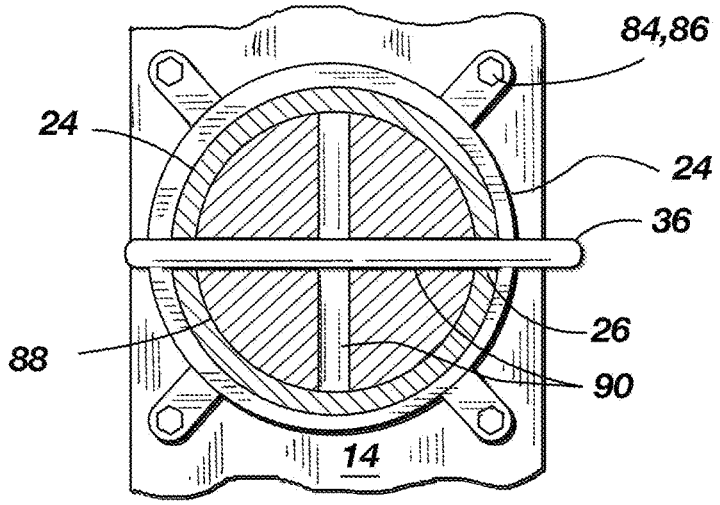
FIG. 19A is an alternative partial detail cross-sectional end view of a flange bearing assembly and shaft positioning the induced flow reciprocating double disc pump assembly in a vertical position as depicted in FIG. 3.
Figure 19B:
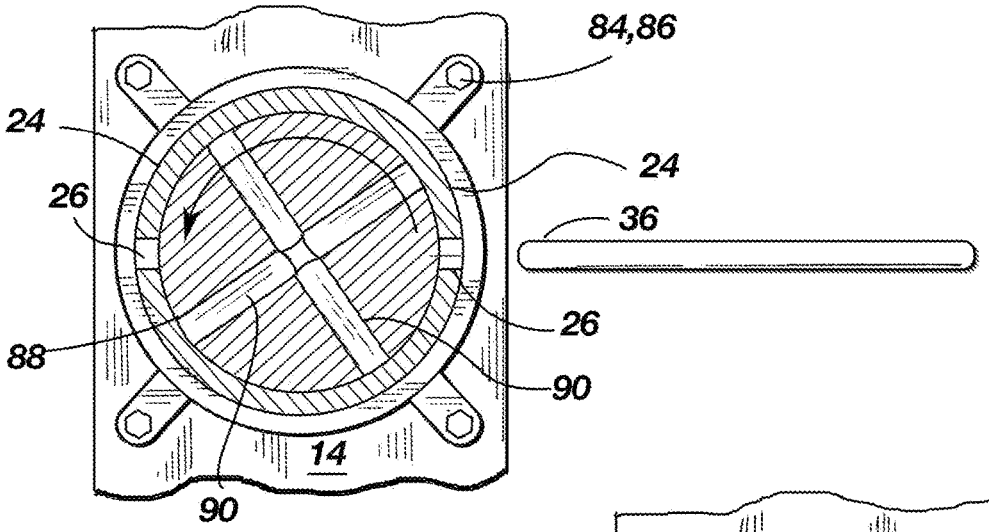
FIG. 19B is an alternative partial detail cross-sectional end view of a flange bearing assembly and shaft during rotation of the induced flow reciprocating double disc pump assembly from a vertical position as depicted in FIG. 3 to a horizontal position as depicted in FIG. 4.
Figure 19C:
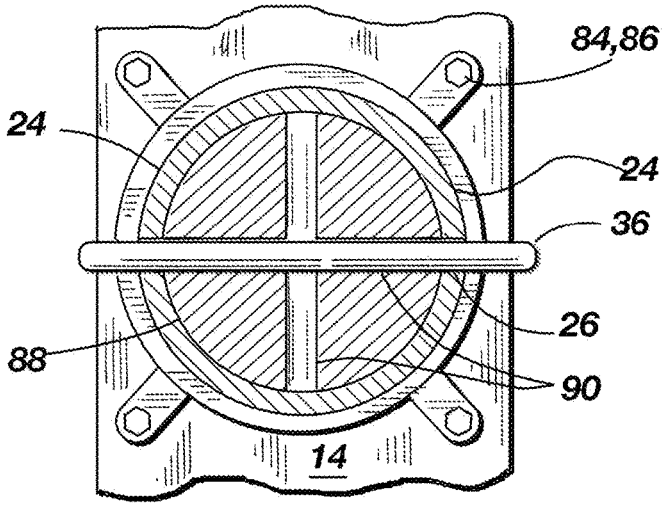
FIG. 19C is an alternative partial detail cross-sectional end view of a flange bearing assembly and shaft positioning the induced flow reciprocating double disc pump assembly in a horizontal position as depicted in FIG. 4.

In a preferred embodiment, as may be seen in detail in FIG. 19A, FIG. 19B and FIG. 19C, around the circumference, the cylindrical inner body 24 will include a plurality of pairs of aligned and regularly spaced positioning holes 26. The positioning holes 26 receive a locking pin 36 which also passes through a pair of aligned and regularly spaced shaft positioning openings 90 extending through the shaft 88, or shaft portions, which are used to secure the double disc pump super structure 10 and the rotating frame element 60 in a desired rotational position relative to the stationary frame element 58.

The desired rotational positioning of the double disc pump super structure 10 and the rotating frame element 60 relative to the stationary frame element 58 may be at an angle of 30 degrees, 45 degrees, 60 degrees, or 90 degrees, to name a few of the many examples of potential rotational positions. It should be understood that rotational positions may also include 150 degrees, 135 degrees, 120 degrees and 90 degrees if the double disc pump super structure 10 and the rotating frame element 60 are rotated in an opposite direction relative to the stationary frame element 58. In addition, it should be noted that the rotational positions identified herein have been provided by way of example and alternative or additional rotational positions may be available dependent upon the requirements of a particular application or environment.

In at least one alternative embodiment as may be seen in FIG. 2 the rotating frame element 60 may be formed of a first perpendicular frame bar 92, a second perpendicular frame bar 94, a first rail conduit 16, a second rail conduit 18, a first vertical support bar 96, a second vertical support bar 98, a third vertical support bar 100, and a fourth vertical support bar 102.

The first perpendicular frame bar 92 and the second perpendicular frame bar 94 are preferably parallel to each other and are respectively disposed above, and offset to the interior of, the third base frame bar 72 and the fourth base frame bar 74. The first perpendicular frame bar 92 and the second perpendicular frame bar 94 are also perpendicular to the horizontal axis of rotation 104 for the rotating frame element 60.

The first perpendicular frame bar 92 and the second perpendicular frame bar 94 in at least one embodiment have an increased size dimension, and may be similar in dimension to the first upright 12 and the second upright 14.

Each of the first perpendicular frame bar 92 and second perpendicular frame bar 94 preferably has a flat top surface which is substantially aligned or flush with respect to the top of the respective first upright 12 and second upright 14. Each of the first perpendicular frame bar 92 and second perpendicular frame bar 94 is also positioned adjacent and interior with respect to the first upright 12 and second upright 14. Further, each of the first perpendicular frame bar 92 and second perpendicular frame bar 94 is centered relative to the center of the first upright 12 and second upright 14.

The positioning of the first perpendicular frame bar 92 and second perpendicular frame bar 94 to the interior of the respective first upright 12 and second upright 14 establishes that the longitudinal length dimension of the rotating frame element 60 is smaller than the longitudinal length dimension of the stationary frame element 58. In addition, in a preferred embodiment, the length dimension of the first perpendicular frame bar 92 and second perpendicular frame bar 94 is smaller than the length dimension of the respective third base frame bar 72 and fourth base frame bar 74, establishing that the normal or width dimension for the rotating frame element 60 is smaller than the normal or width dimension of the stationary frame element 58.

Each of the first perpendicular frame bar 92 and second perpendicular frame bar 94 include an integral and centrally positioned shaft 88 (or aligned shaft portions) extending outwardly therefrom. Each of the shafts 88 are inserted into the interior of a respective first flange bearing assembly 20 and second flange bearing assembly 21. Each of the shafts 88 include the shaft positioning openings 90 as earlier described.

The first vertical support bar 96, second vertical support bar 98, third vertical support bar 100 and the fourth vertical support bar 102 preferably have identical dimensions and extend vertically from a respective corner or end of the first perpendicular frame bar 92 and second perpendicular frame bar 94.

In at least one embodiment, a first rail conduit 16 extends longitudinally between the first vertical support bar 96 and the second vertical support bar 98. A second rail conduit 18 extends longitudinally between the fourth vertical support bar 102 and the third vertical support bar 100. Each of the first rail conduit 16 and the second rail conduit 18 have a flat top surface having a plurality of mantel affixation openings 34 which receive lugs 30 which securely affix the mantel block 32 and/or the block conduits 108 as integral with, or as engaged to, the double disc pump super structure 10, to the top of the first rail conduit 16 and the second rail conduit 18.

The length of the first rail conduit 16 and the second rail conduit 18 is sufficient to engage and to support the mantel block 32 and/or the block conduits 108 on the opposite sides of the double disc pump super structure 10 along the horizontal axis of rotation 104. The separation dimension between the first rail conduit 16 and the second rail conduit 18, in a normal direction relative to the horizontal axis of rotation 104 is sufficient to engage the mantel block 32 and/or the block conduits 108 of the double disc pump super structure 10.

In at least one embodiment the vertical dimensions selected for the first vertical support bar 96, second vertical support bar 98, third vertical support bar 100 and the fourth vertical support bar 102 is sufficient to avoid contact between the top of the double disc pump super structure 10 and the cross brace bar 28 if the double disc pump super structure 10 is rotated 180 degrees from a normal operational position. In at least one embodiment the first vertical support bar 96, second vertical support bar 98, third vertical support bar 100 and the fourth vertical support bar 102 may be eliminated and the first rail conduit 16 and the second rail conduit 18 may directly engage the flat upper surface of the exterior ends of the respective first perpendicular frame bar 92 and the second perpendicular frame bar 94.

Figure 3:
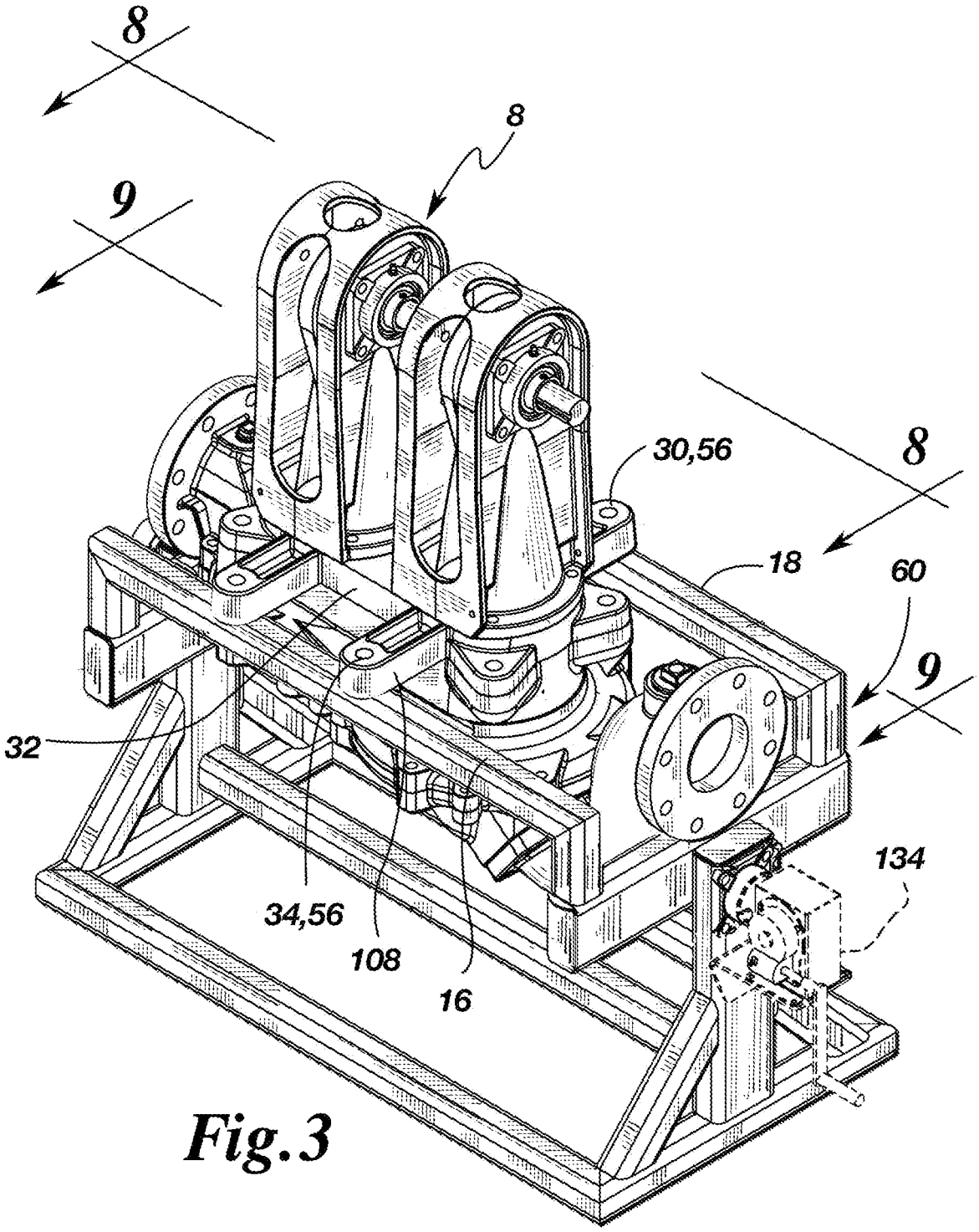
FIG. 3 is a perspective view of one alternative embodiment of the induced flow reciprocating double disc pump assembly.

Referring to FIG. 3, in a preferred embodiment, the double disc pump super structure 10 is shown as engaged to the rotating frame element 60 where the mantel block 32 is positioned upon the upper flat surfaces of the first rail conduit 16 and the second rail conduit 18. Lugs 30 or other mechanical fasteners such as bolts may be inserted through aligned mantel affixation openings 34 and mantel block apertures 56 to secure the double disc pump super structure 10 to the rotating frame element 60.

As may be seen in FIG. 3 the double disc pump super structure 10 is shown in an upright operative position relative to the rotating frame element 60 and stationary frame element 58.

Figure 4:
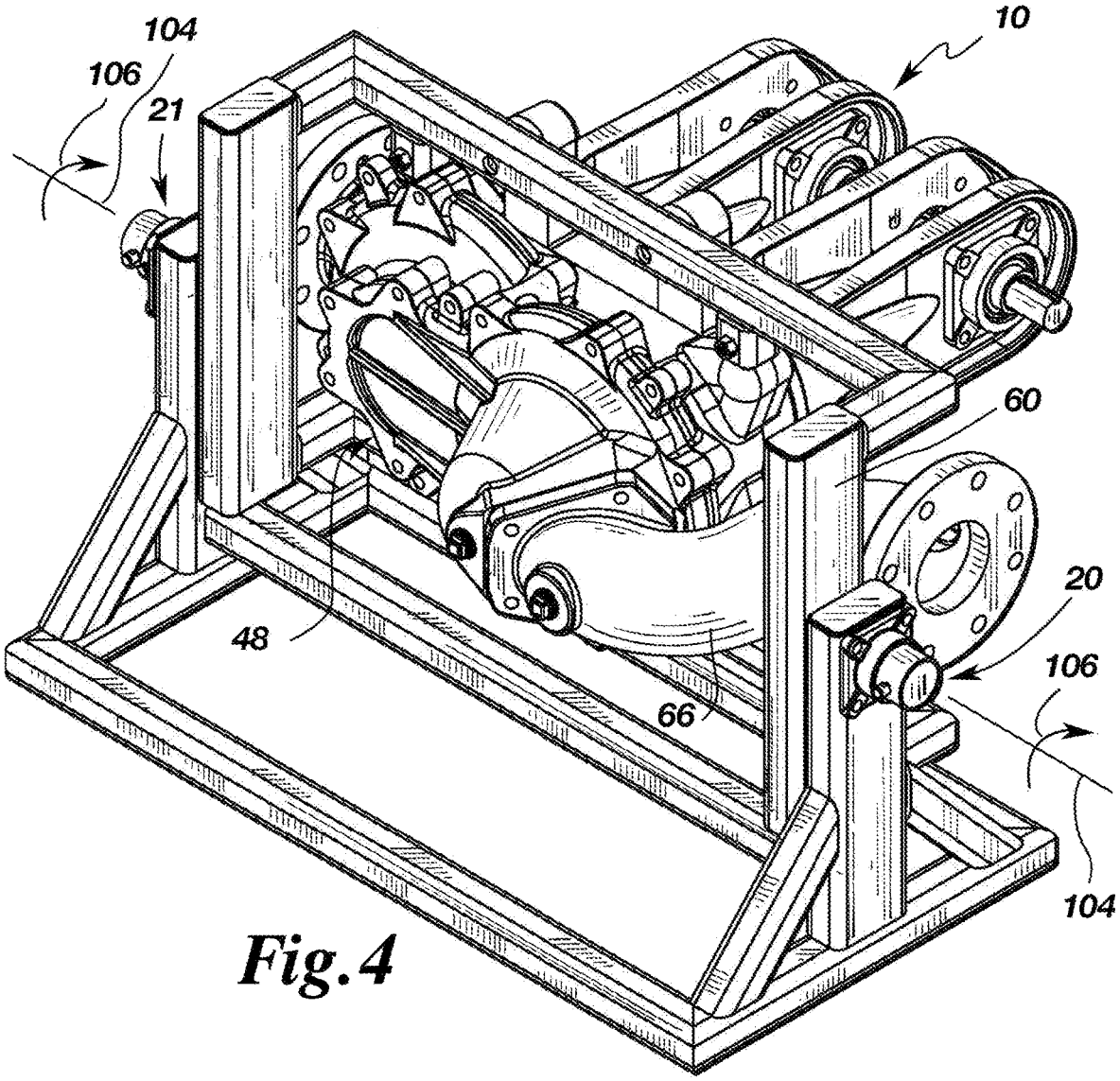
FIG. 4 is an alternative perspective view of one alternative embodiment of the induced flow reciprocating double disc pump assembly with the double disc pump super structure rotated 90 degrees relative to the stationary frame elements.

As may be seen in FIG. 4 the double disc pump super structure 10 and the rotating frame element 60 is shown in a 90 degree rotated position about the horizontal axis of rotation 104 relative to the stationary frame element 58. In the embodiment of FIG. 4 the double disc pump super structure 10 and the rotating frame element 60 have been rotated about the first flange bearing assembly 20 and the second flange bearing assembly 21 in a clockwise direction as indicated by arrow 106. The rotated orientation of the double disc pump super structure 10 relative to the stationary frame element 58 as shown in FIG. 4 facilitates the performance of service to the inlet suction housing 48, intermediate housing 50 and the swan neck elbow 66.

Figure 6:
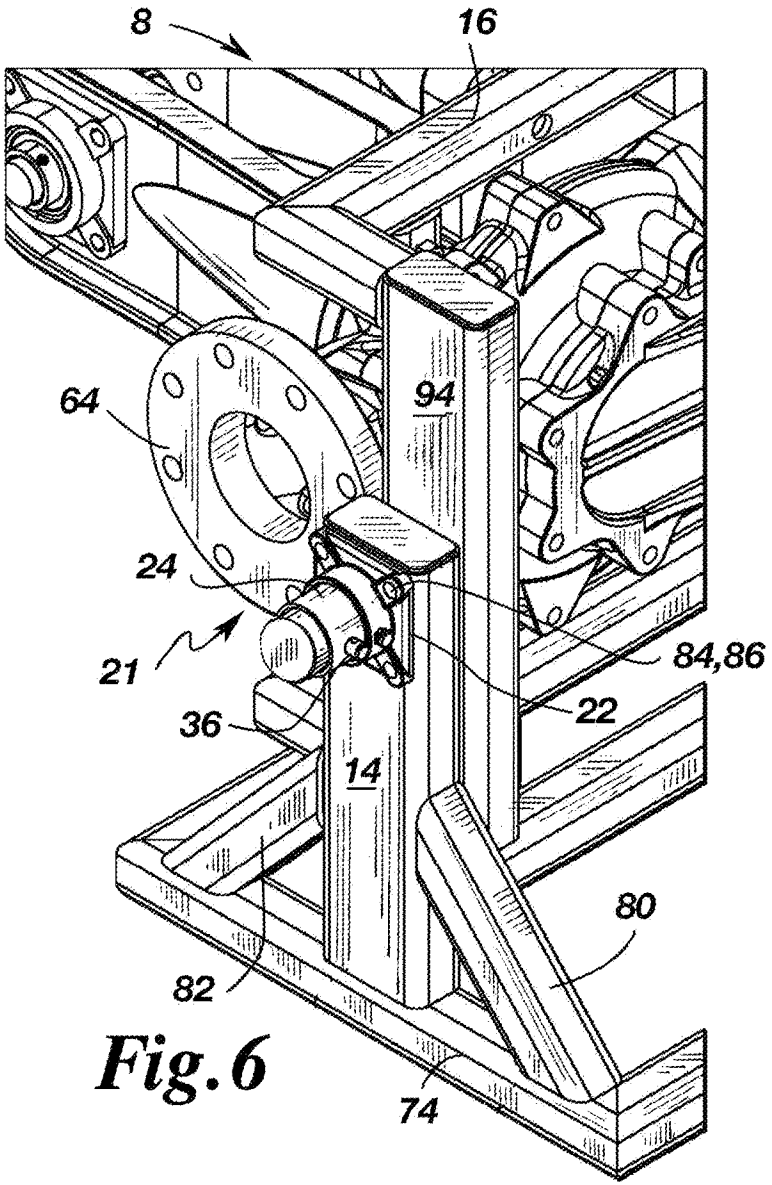
FIG. 6 is a detail perspective view of one alternative embodiment of the flange bearings of the induced flow reciprocating double disc pump assembly.
Figure 5:
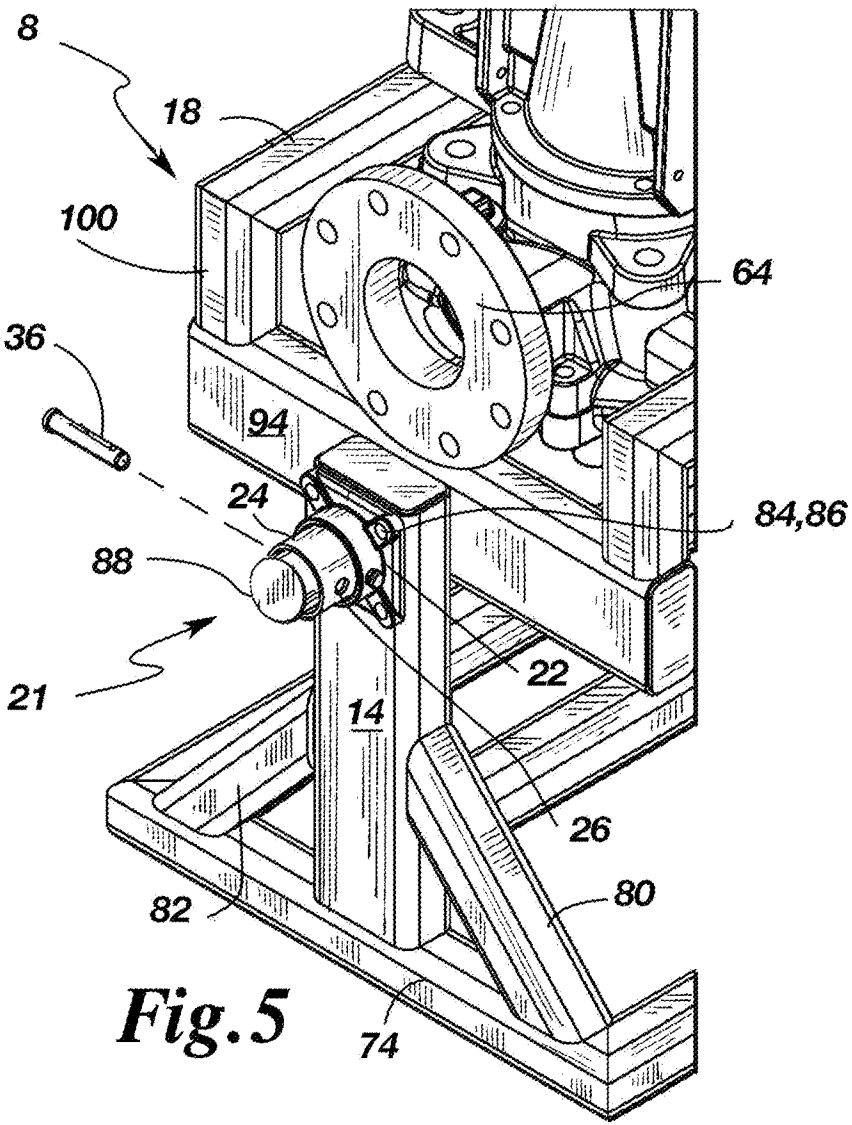
FIG. 5 is a detail exploded perspective view of one alternative embodiment of the flange bearings of the induced flow reciprocating double disc pump assembly.

Referring to FIG. 5 and FIG. 6, in one alternative embodiment a detail end view of the induced flow reciprocating double disc pump assembly 8, second flange bearing assembly 21 and the suction coupler 62 is shown.

In FIG. 5 the double disc pump super structure 10 is in an upright operative position as indicated in FIG. 3. As shown in FIG. 5 the locking pin 36 is withdrawn from the positioning holes 26 enabling rotation of the double disc pump super structure 10 and the rotating frame element 60 about the stationary frame element 58 through use of the second flange bearing assembly 21.

In FIG. 6 the double disc pump super structure 10 and the rotating frame element 60 have been rotated about the stationary frame element 58, through use of the second flange bearing assembly 21, approximately 90 degrees in a clockwise direction (FIG. 4). The locking pin 36 has been inserted into an alternative set of aligned positioning holes 26 and shaft positioning openings 90. As shown in FIG. 6 the double disc pump super structure 10 and the rotating frame element 60 have been secured in a non-operative position to facilitate servicing of the double disc pump super structure 10 by the insertion of the locking pin 36 into the aligned positioning holes 26 and shaft positioning openings 90.

Figure 7:
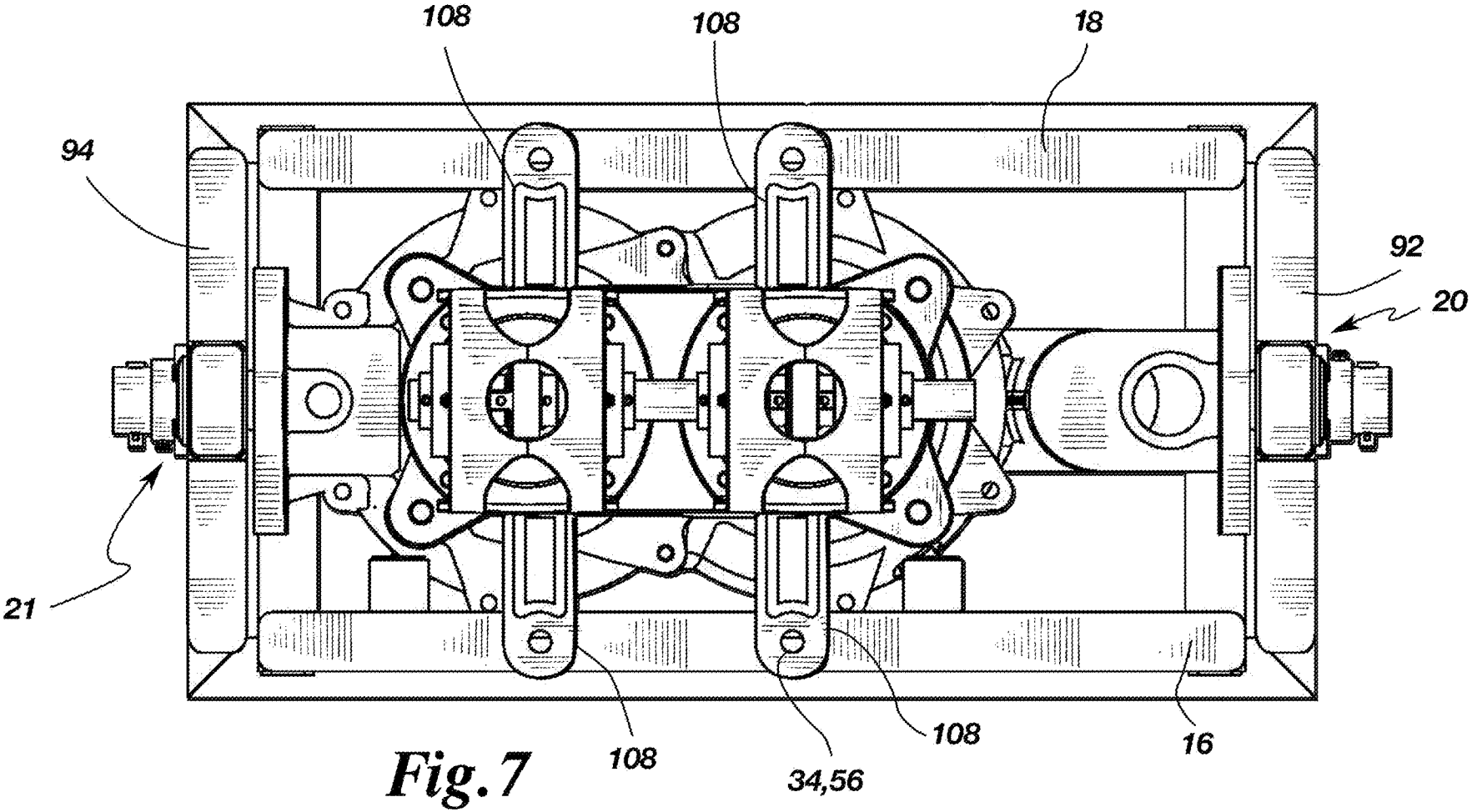
FIG. 7 is a top plan view of one alternative embodiment of the induced flow reciprocating double disc pump assembly.

In at least one alternative embodiment as shown in FIG. 7, FIG. 1, and FIG. 3 the mantel block 32 for the double disc pump super structure 10 may integrally include, or may be modified to include, a plurality of outwardly and perpendicularly extending block conduits 108. In FIG. 7, FIG. 1, and FIG. 3 four block conduits 108 are shown. In alternative embodiments more or less than four block conduits 108 may be utilized to secure the double disc pump super structure 10 to the first rail conduit 16 and the second rail conduit 18 dependent on the requirements of a particular application. In at least one embodiment lugs 30 or other mechanical fasteners such as bolts or bolts and nuts may pass through the mantel affixation openings 34 and the mantel block apertures 56 to secure the block conduits 108 to the first rail conduit 16 and the second rail conduit 18.

The induced flow reciprocating double disc pump assembly 8 enhances the ease of access and service to the pumping components of the double disc pump super structure 10 through the rotation of the rotating frame element 60 securing the double disc pump super structure 10 relative to the stationary frame element 58.

In an alternative embodiment as may be seen in FIG. 3 a hand crank or mechanical or rotary winch 134 may be used to rotate the double disc pump super structure 10. The hand crank 134 provides for the controlled and effective rotational movement of the double disc pump super structure 10 about the horizontal axis of rotation 104 eliminating a need for hydraulics. In some embodiments, the hand crank 134 may be removed and an electric device such as a hand drill may replace the handle for manipulation of the hand crank 134. In alternative embodiments the hand crank 134 may include chains engaged to one or more sprockets as connected to the shaft 88; may include one or more belts as connected to the shaft 88; or may be formed of one or more mating gears as connected to the shaft 88. In at least one alternative embodiment, an electric motor may be engaged to the hand crank 134 to provide the movement of the double disc pump super structure 10 about the horizontal axis of rotation 104.

Figure 8:
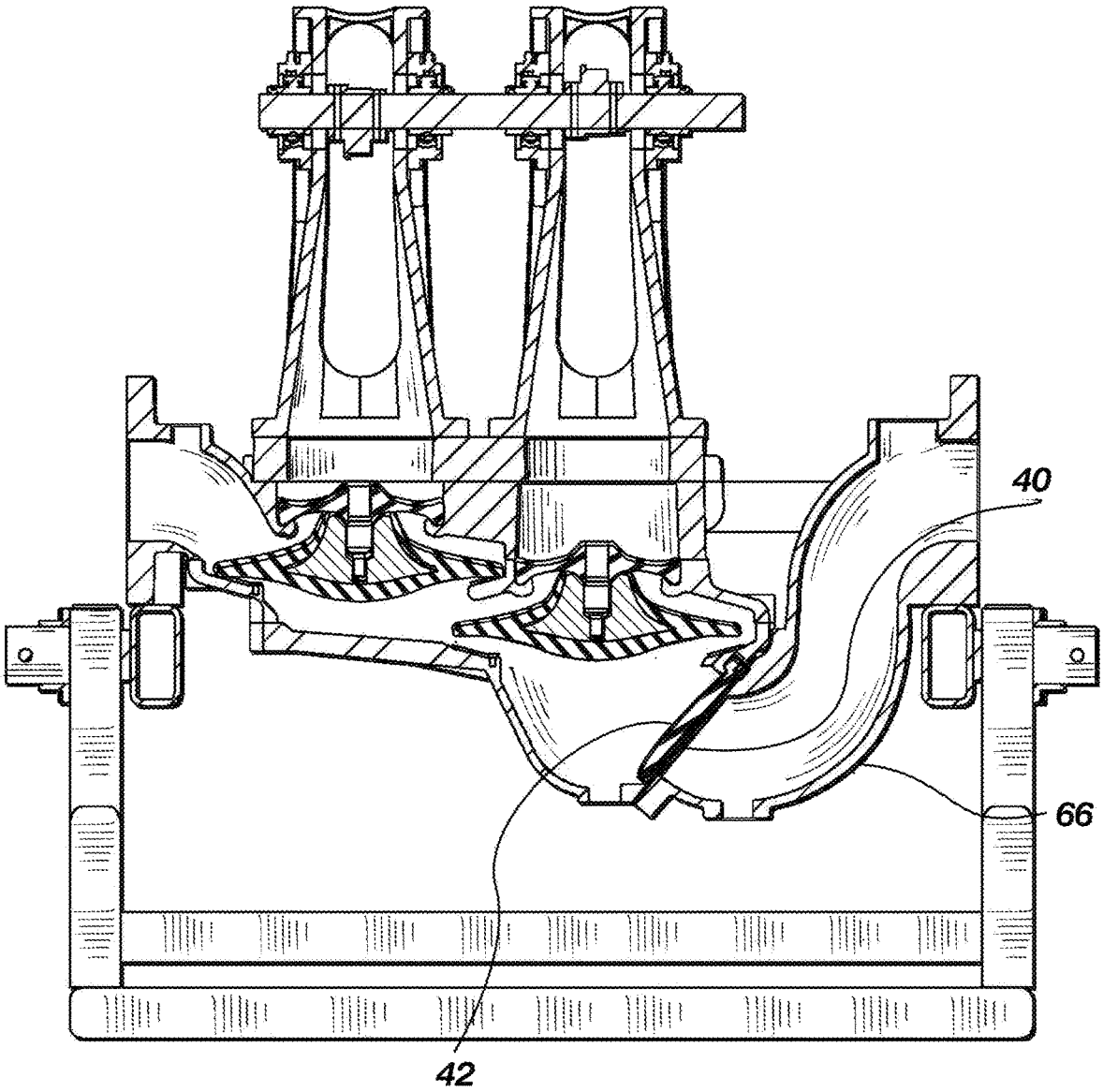
FIG. 8 is a cross-sectional side view of one alternative embodiment of the induced flow reciprocating double disc pump assembly taken along the line 8-8 of FIG. 3.
Figure 9:
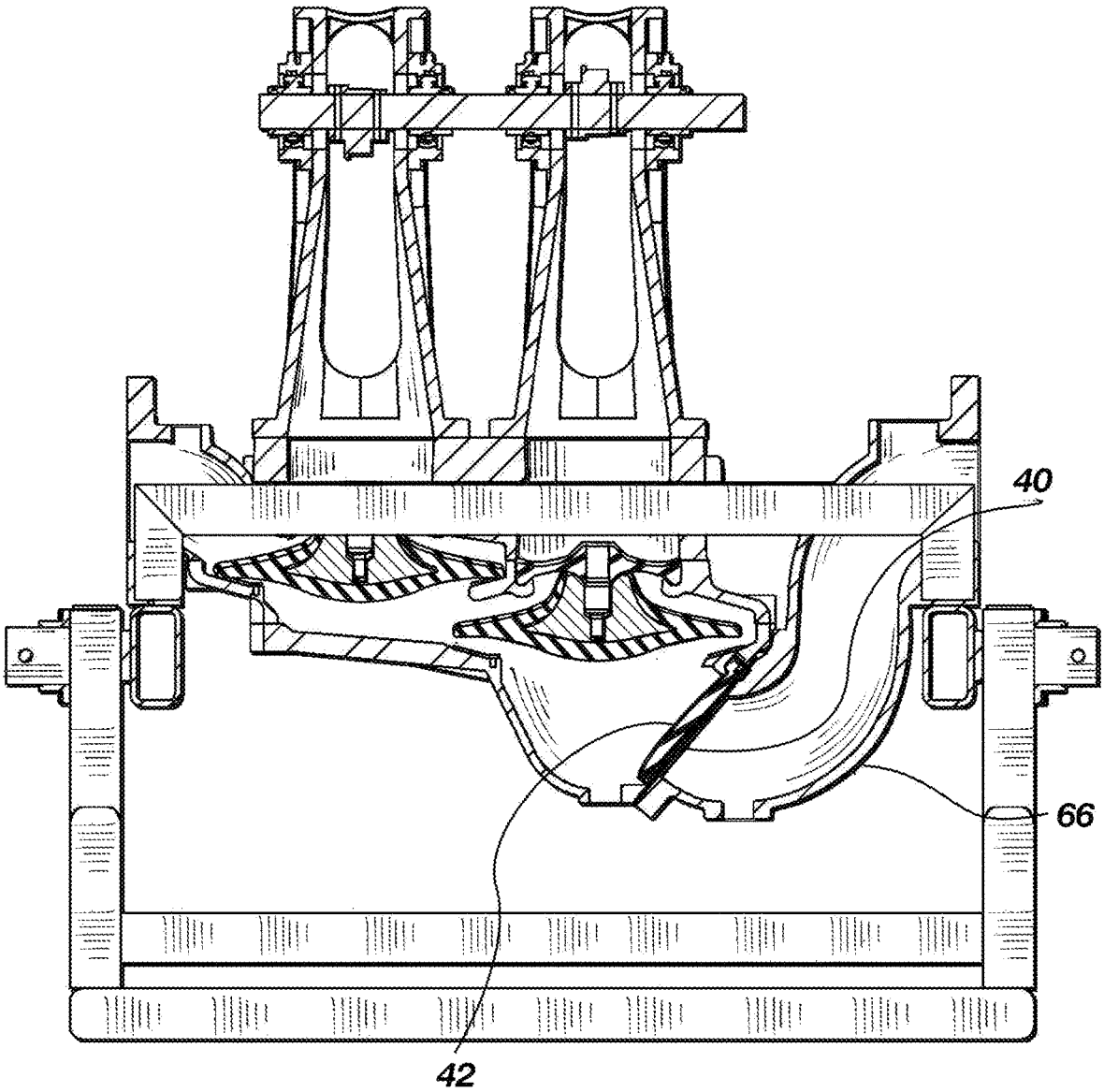
FIG. 9 is a cross-sectional side view of one alternative embodiment of the induced flow reciprocating double disc pump assembly taken along the line 9-9 of FIG. 3.
Figure 12:
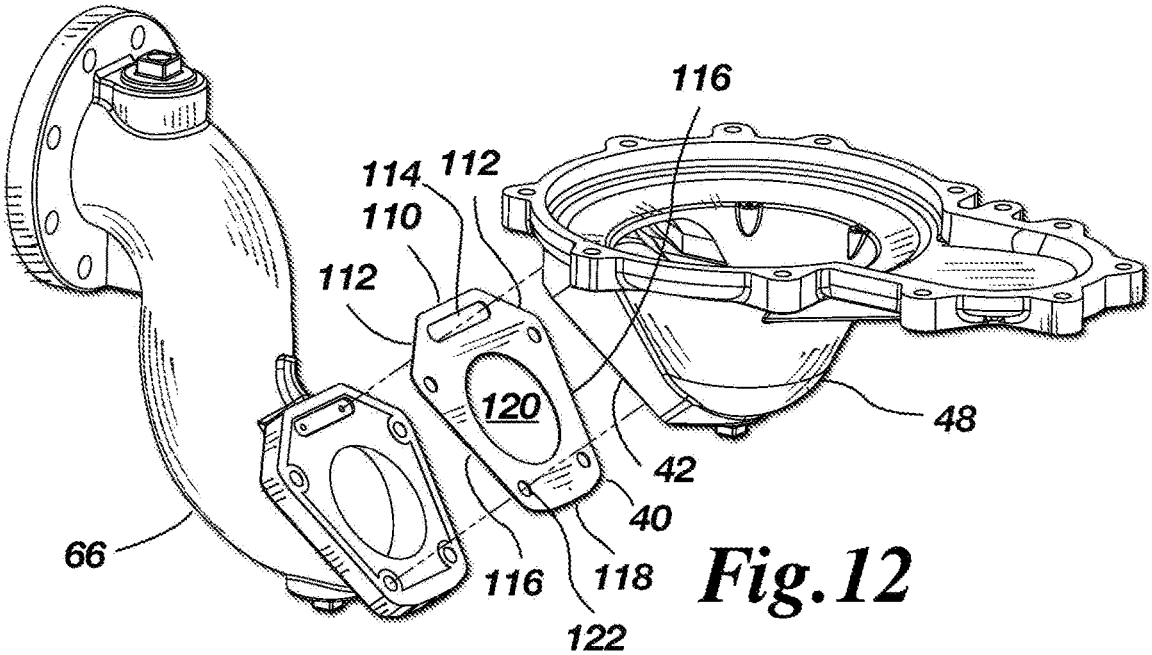
FIG. 12 is an alternative detail exploded perspective view of one alternative embodiment of the inlet suction housing and intermediate housing of a double disc pump super structure.

In an alternative embodiment as may be seen in FIG. 8, FIG. 9 and FIG. 12 a replaceable valve seat 40 is shown. The replaceable valve seat 40 is located between the swan neck elbow 66 and the suction flapper clack valve 42. The replaceable valve seat 40 may be secured between the swan neck elbow 66 and the suction flapper clack valve 42 through the use of conventional mechanical fasteners such as nuts and/or nuts and bolts.

The replaceable valve seat 40 generally has a modified shield shape having a horizontal upper surface 110, a pair of angularly and outwardly extending upper transition edges 112, a horizontal channel 114 located below the horizontal upper surface 110 and centrally between the upper transition edges 112. The replaceable valve seat 40 also generally has elongate angularly downwardly and inwardly extending side edges 116 and a slightly outwardly bowed arcuate bottom edge 118 extending between the bottom of the angularly downwardly and inwardly extending side edges 116. The replaceable valve seat 40 includes a central oval shaped opening 120 and a plurality of attachment apertures 122.

The replaceable valve seat 40 may be form fitted and fabricated from materials including but not limited to steel, stainless steel or other durable or coated materials suitable for the type of product being pumped. The material selected for the replaceable valve seat 40 may be specifically selected when pumping corrosive materials. The replaceable valve seat 40 may be easily and conveniently replaced by rotatable positioning of the double disc pump super structure 10 and rotating frame element 60 relative to the stationary frame element 58 as earlier described.

Figure 10:
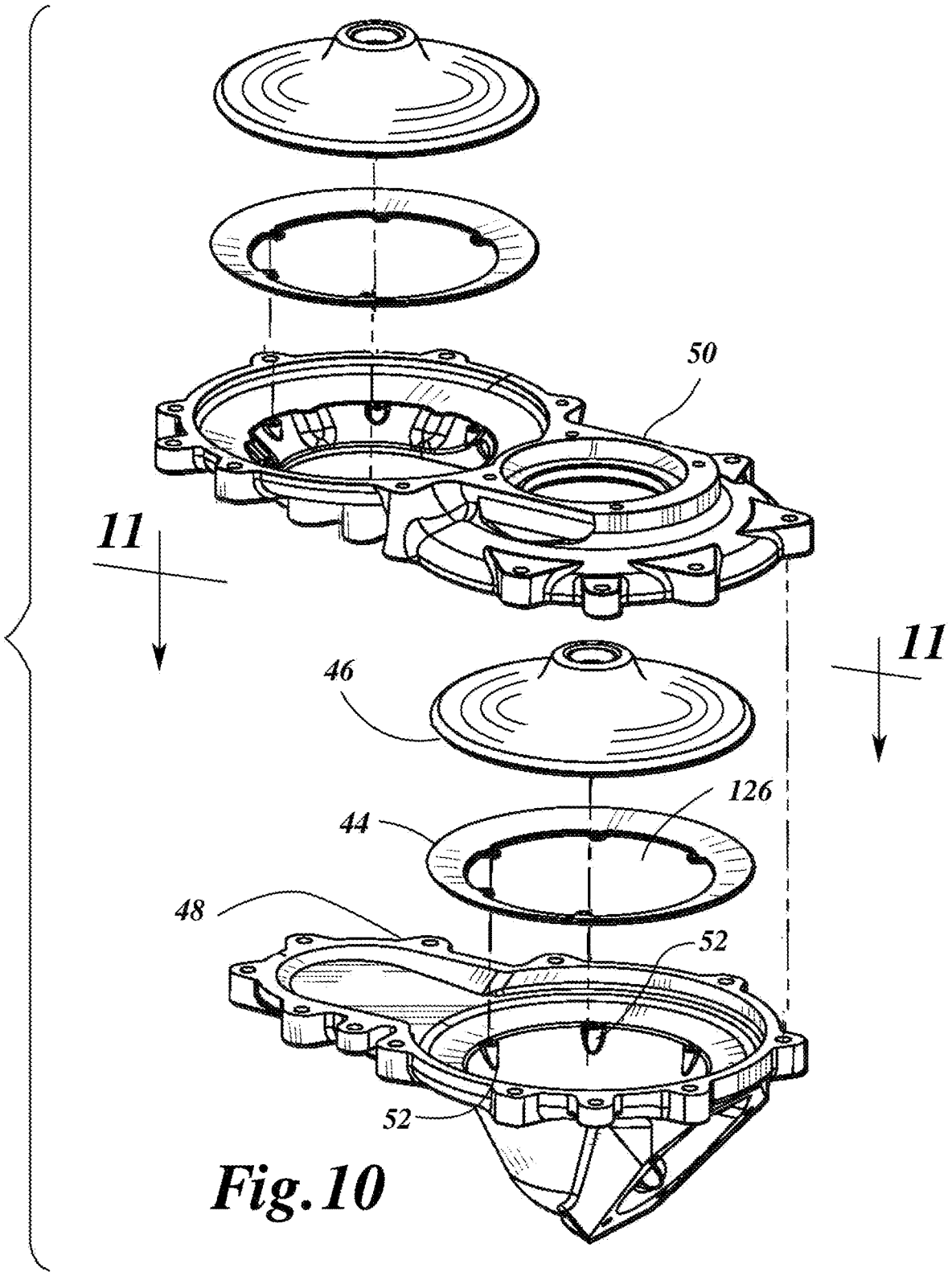
FIG. 10 is a detail exploded perspective view of the inlet suction housing and intermediate housing of one alternative embodiment of a double disc pump super structure.
Figure 11:
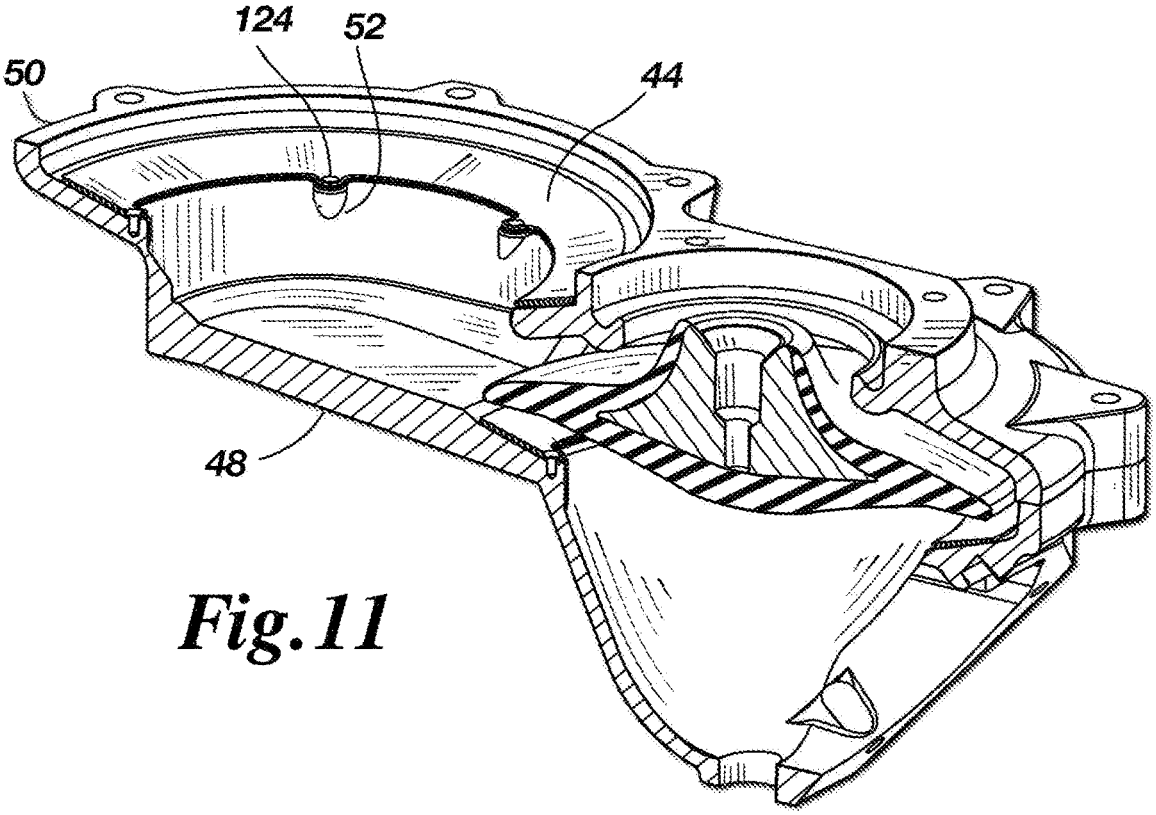
FIG. 11 is a partial detail cross-sectional perspective view of one alternative embodiment of the inlet suction housing and intermediate housing of a double disc pump super structure taken along the line 11-11 of FIG. 10.
Figure 18:
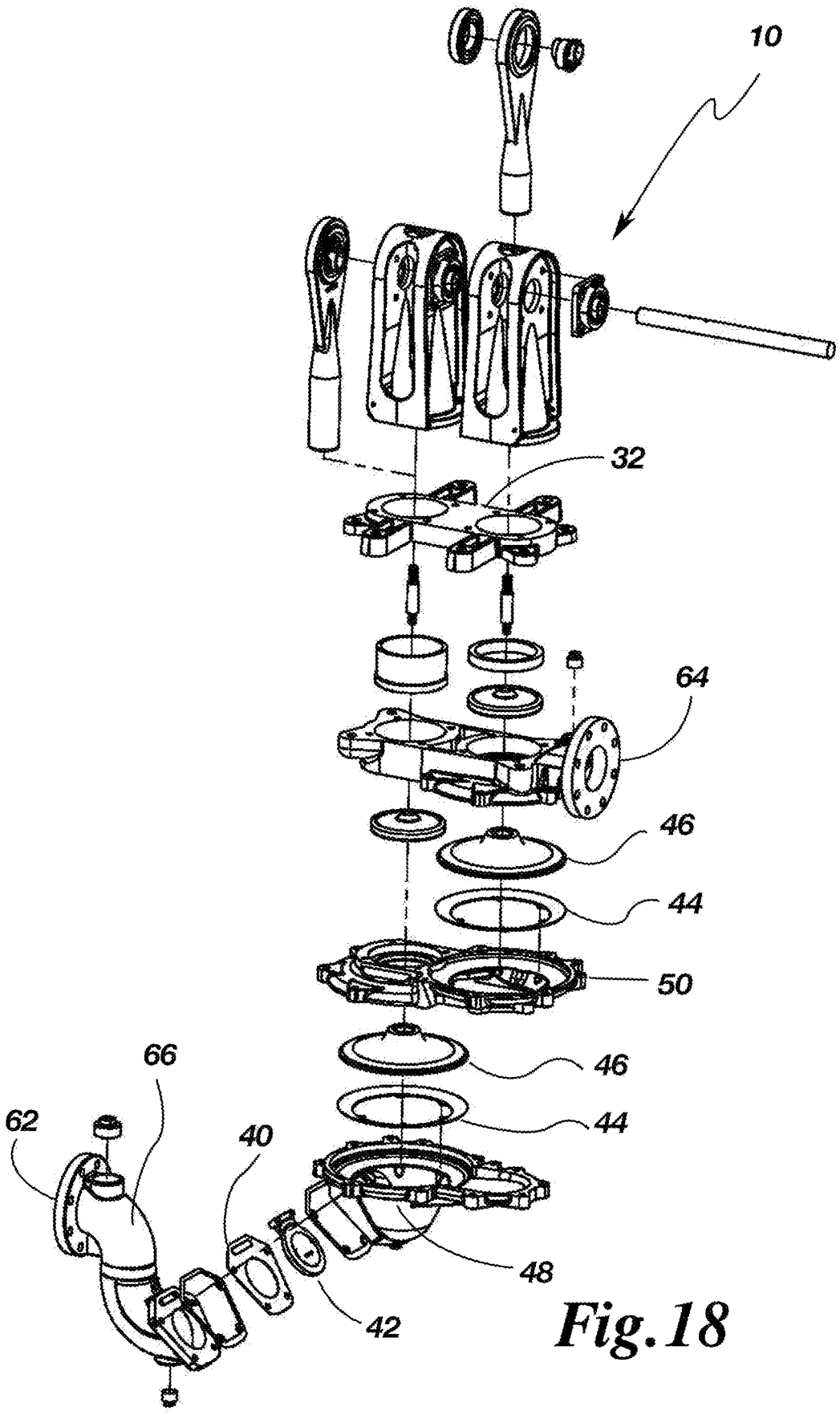
FIG. 18 is an alternative partial detail exploded perspective view of one alternative embodiment of the double disc pump super structure of the induced flow reciprocating double disc pump assembly.

In an alternative embodiment as may be seen in FIG. 10, FIG. 11 and FIG. 18, a renewable valve seat 44 is shown. The renewable valve seat 44 is generally circular in shape and is dished for flush engagement to the interior, above the inlet suction housing 48, and between the inlet suction housing 48, a disc 46 and the intermediate housing 50. In addition or alternatively, the renewable valve seat 44 may be positioned for flush engagement to the interior and above the intermediate housing 50, between the intermediate housing 50, a disc 46 and the underside of the double disc pump super structure 10.

The renewable valve seat 44 includes a circular opening 126 and a plurality of receiver apertures 124 regularly spaced about and extending to the interior of the circular opening 126. The plurality of receiver apertures 124 are constructed and arranged for alignment to a plurality of regularly spaced threaded receivers 52 as integral to the interior of the inlet suction housing 48.

The renewable valve seat 44 may be form fitted and fabricated from materials including but not limited to steel, stainless steel or other durable or coated materials suitable for the type of product being pumped. The material selected for the renewable valve seat 44 may be specifically selected when pumping corrosive materials. The renewable valve seat 44 may be easily and conveniently replaced by rotatable positioning of the double disc pump super structure 10 and rotating frame element 60 relative to the stationary frame element 58 as earlier described.

In an alternative embodiment as may be seen in FIG. 13, FIG. 14, FIG. 15, FIG. 16 and FIG. 17 the bottom or underside of the double disc pump super structure 10 is shown to include a plurality of guide rods 54. The guide rods 54 are constructed and arranged to pass through guide rod openings 128 and to be releasably secured to the guide rod receivers 132 of the mantel block 32. The engagement end of the guide rods 54 may be threaded for engagement to internal threads within the guide rod receivers 132. The guide rods 54 are preferably formed of sturdy metallic material which will not bend or fail while supporting the inlet suction housing 48 and intermediate housing 50 of the double disc pump super structure 10 during assembly, disassembly and/or servicing. The material selected for the guide rods 54 is also preferably formed of corrosive resistant material.

The guide rods 54 function as slider rails to maintain alignment between the inlet suction housing 48, the intermediate housing 50 and the double disc pump super structure 10 in order to prevent the inlet suction housing 48 or the intermediate housing 50 from dropping due to gravity once the fasteners have been removed from the double disc pump super structure 10, permitting the inlet suction housing 48 and/or the intermediate housing 50 to be separated from the double disc pump super structure 10 in a controlled and safe manor.

Figure 13:
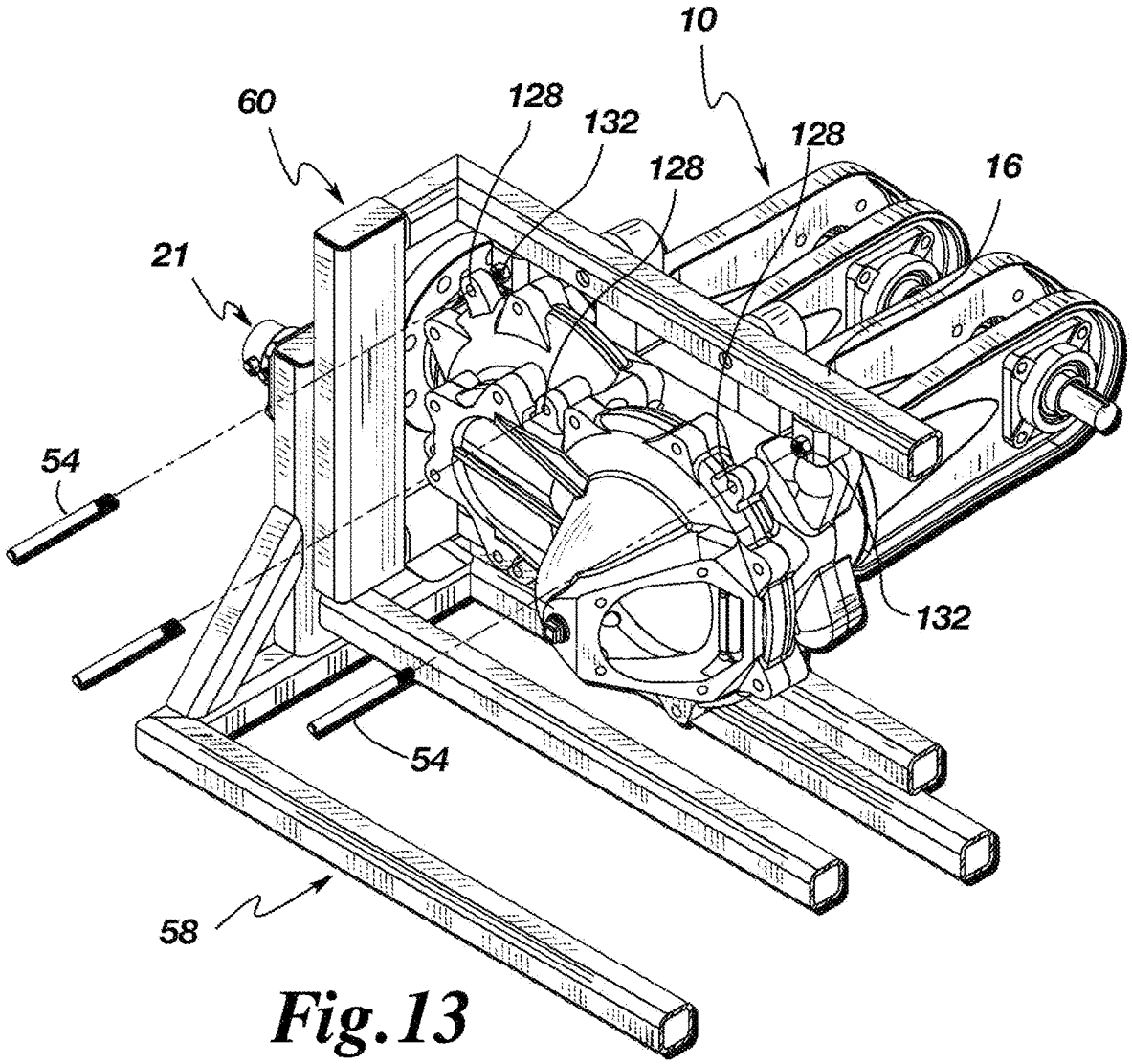
FIG. 13 is an alternative partial exploded perspective view of one alternative embodiment of the induced flow reciprocating double disc pump assembly, showing the guide rods, with the double disc pump super structure rotated 90 degrees relative to the stationary frame elements.

Referring in more detail to FIG. 13 one embodiment of the location of the guide rods 54 is shown for engagement into the guide rod openings 128, the guide rod receivers 132 and the double disc pump super structure 10. In FIG. 13 the guide rods 54 are located proximate to the upper portion of the underside of the double disc pump super structure 10 or proximate to the first rail conduit 16. In FIG. 13 the rotating frame element 60 securing the double disc pump super structure 10 has been rotated approximately 90 degrees relative to the stationary frame element 58 as earlier described. The guide rods 54 may be releasably engaged to the guide rod openings 128, the guide rod receivers 132 and the double disc pump super structure 10 after rotation and immediately prior to service of the inlet suction housing 48, the intermediate housing 50 and the double disc pump super structure 10. Alternatively, the guide rods 54 may be engaged to the guide rod openings 128, the guide rod receivers 132 during use of the induced flow reciprocating double disc pump assembly 8.

Figure 14:
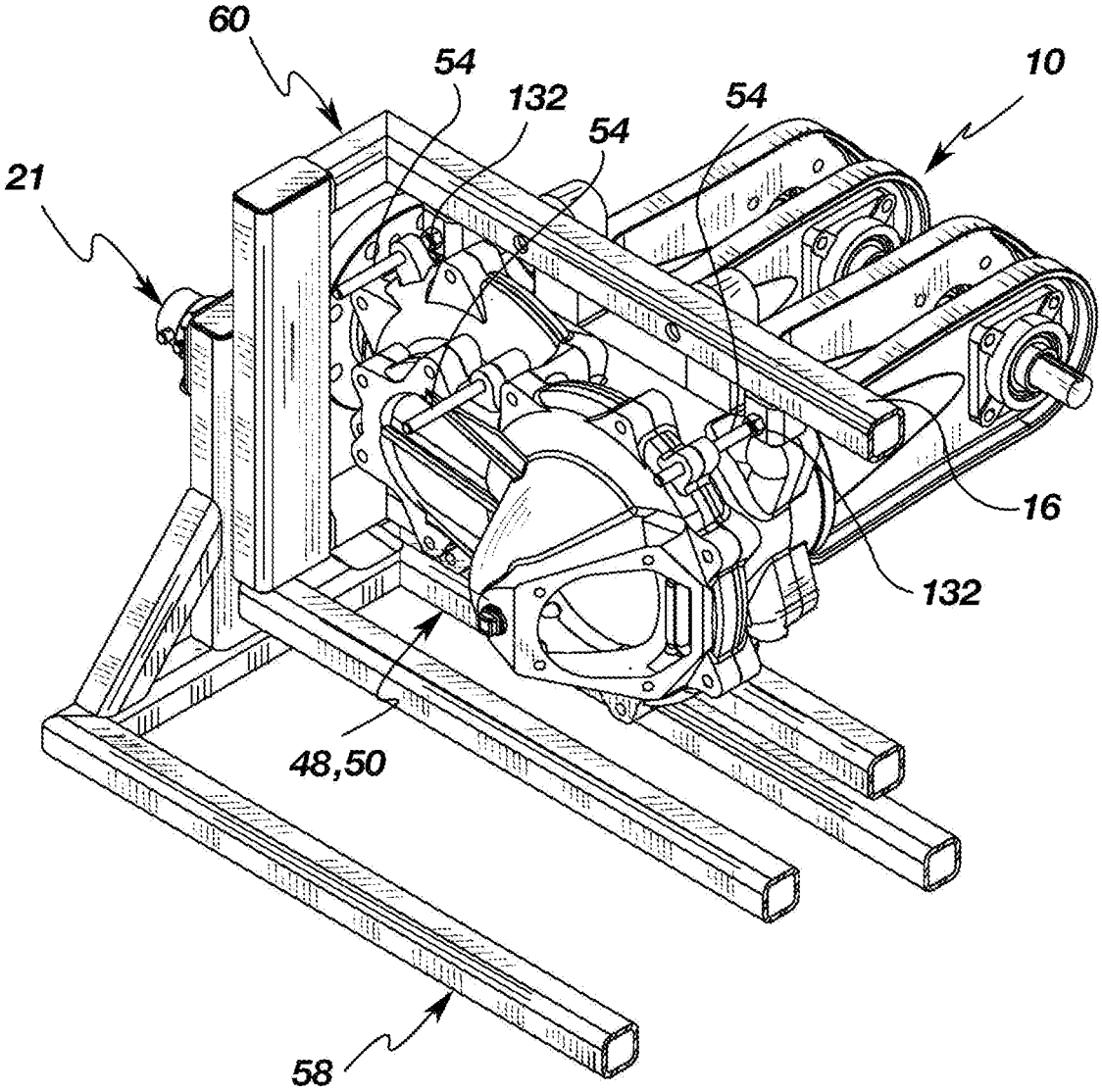
FIG. 14 is an alternative perspective view of one alternative embodiment of the induced flow reciprocating double disc pump assembly, showing the guide rods, with the double disc pump super structure rotated 90 degrees relative to the stationary frame elements.

Referring in more detail to FIG. 14 the guide rods 54 are shown in an operative engaged position relative to the guide rod openings 128, the guide rod receivers 132 and the double disc pump super structure 10. In FIG. 14 the rotating frame element 60 securing the double disc pump super structure 10 has been rotated approximately 90 degrees relative to the stationary frame element 58 as earlier described. As shown in FIG. 14 the intermediate housing 50 and the inlet suction housing 48 are releasably secured to the underside of the double disc pump super structure 10.

Figure 15:
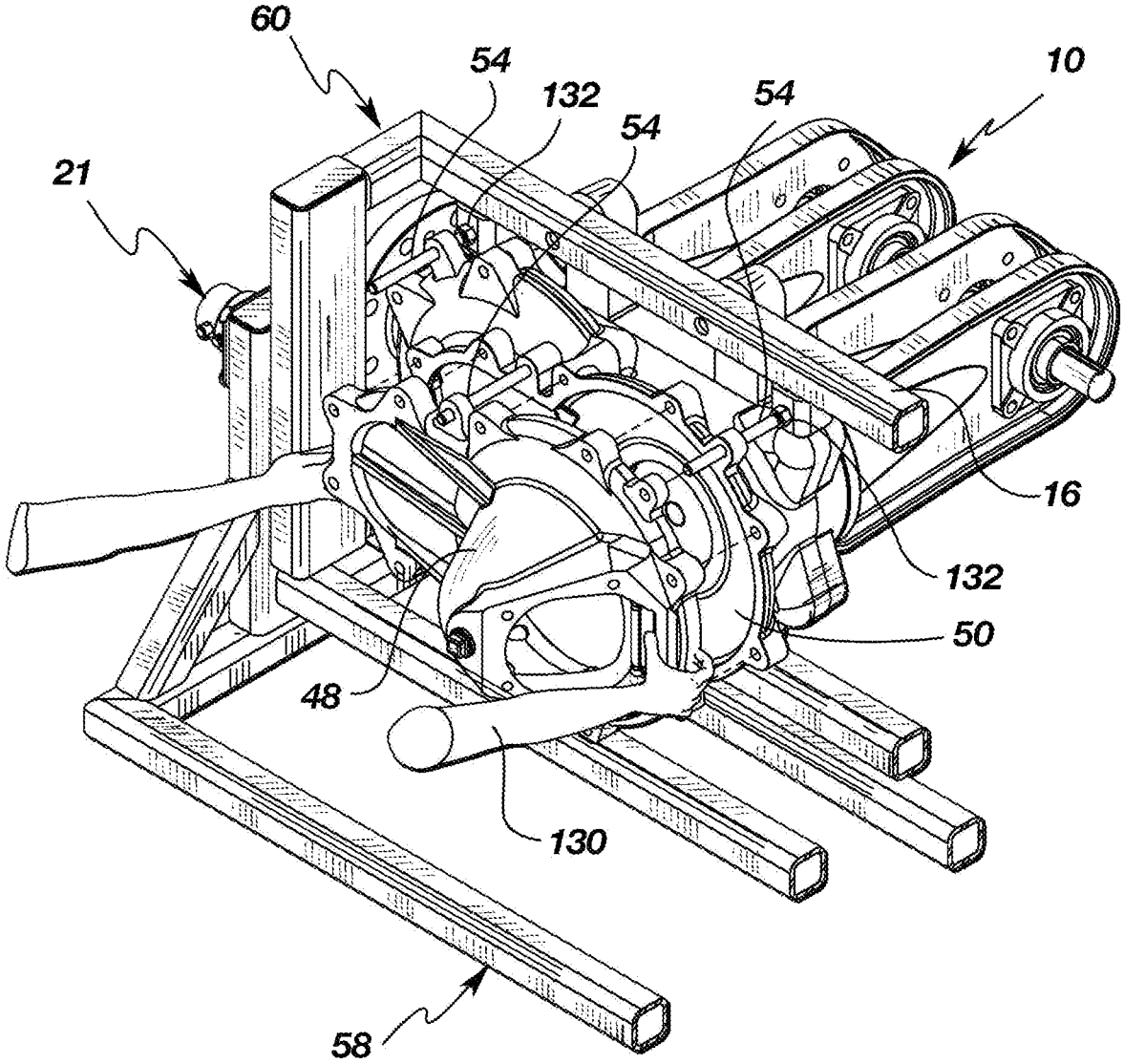
FIG. 15 is an alternative exploded perspective view of one alternative embodiment of the induced flow reciprocating double disc pump assembly, showing the guide rods, with the double disc pump super structure rotated 90 degrees relative to the stationary frame elements.

Referring in more detail to FIG. 15 an individual's arms and hands 130 are shown sliding the inlet suction housing 48 in a horizontal and outward direction relative to the intermediate housing 50 and the double disc pump super structure 10 on the guide rods 54. This direction of outward movement of the inlet suction housing 48 or the intermediate housing 50 on the guide rods 54 during disassembly, assembly and/or servicing, eliminates the need for hinges, where a workman is disposed under a double disc pump super structure 10, where the inlet suction housing 48 is dropped downwardly towards the workman. As shown in FIG. 15 the inlet suction housing 48 is drawn outwardly from the double disc pump super structure 10 and the weight of the inlet suction housing 48 is fully, or at least partially, supported by the guide rods 54. The guide rods 54 improve the safety of workers servicing a double disc pump super structure 10.

Figure 16:
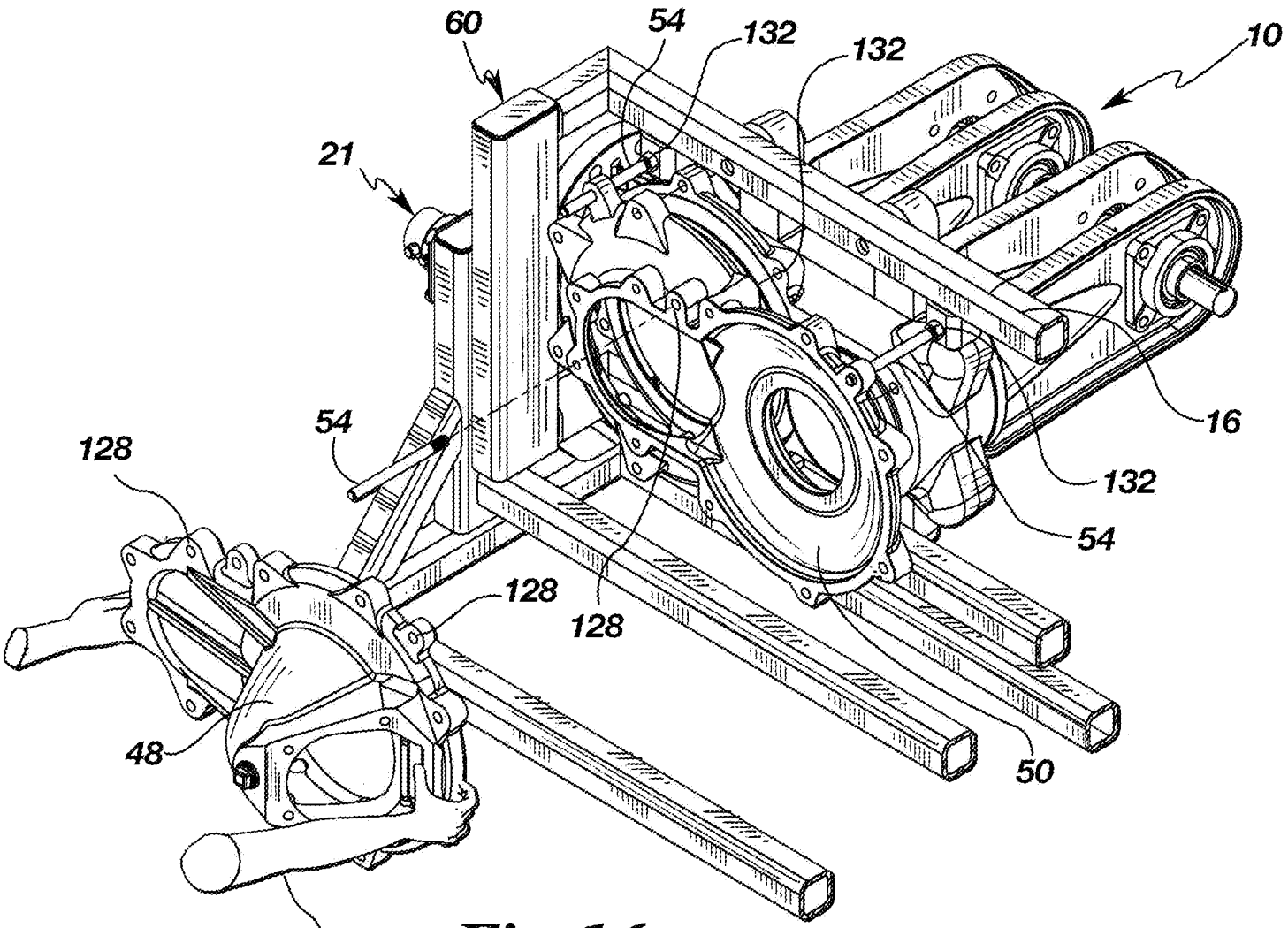
FIG. 16 is an alternative exploded perspective view of one alternative embodiment of the induced flow reciprocating double disc pump assembly, showing the guide rods, with the double disc pump super structure rotated 90 degrees relative to the stationary frame elements.

Referring in more detail to FIG. 16, inlet suction housing 48 has been separated from the double disc pump super structure 10 and the guide rods 54. In addition, the intermediate housing 50 is being moved/slid in a horizontal and outward direction relative to the double disc pump super structure 10 on the guide rods 54. During the separation, the weight of the intermediate housing 50 is fully, or at least partially, supported by the guide rods 54 improving the safety of workers servicing a double disc pump super structure 10.

Figure 17:
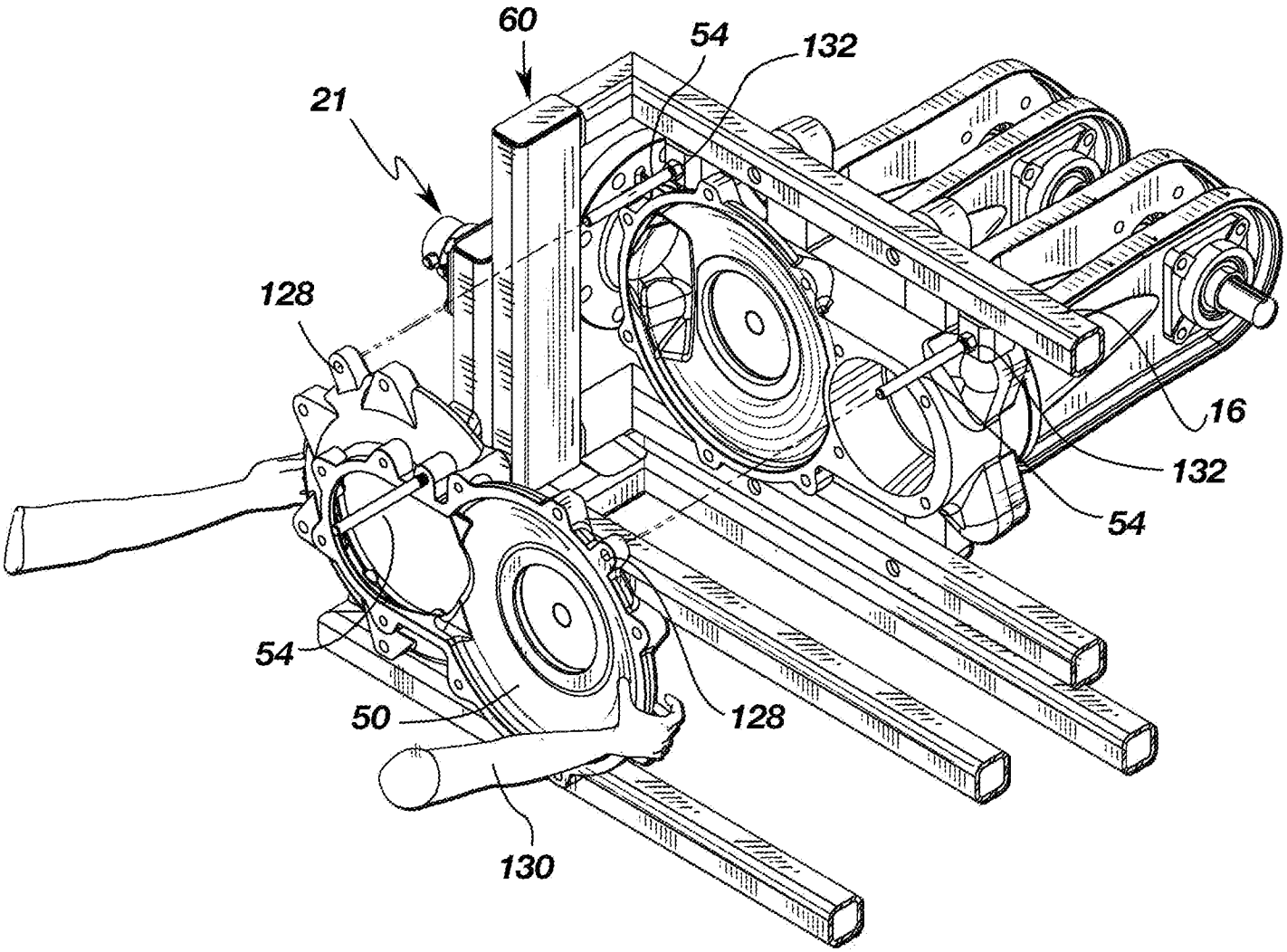
FIG. 17 is an alternative partial detail exploded perspective view of one alternative embodiment of the inlet suction housing, intermediate housing and guide rods of the induced flow reciprocating double disc pump assembly, with the double disc pump super structure rotated 90 degrees relative to the stationary frame elements.

Referring in more detail to FIG. 17, intermediate housing 50 has been separated from the double disc pump super structure 10 and the guide rods 54 permitting access to the interior components of the double disc pump super structure 10.

The induced flow reciprocating double disc pump assembly 8 may include any desired number of guide rods 54 as deemed optimal for a particular application. While in the alternative embodiments depicted herein, three guide rods 54 are shown, alternatively two guide rods 54 or four or more guide rods 54 my be utilized. Alternatively, the guide rods 54 may be disposed on both of the opposite sides of the double disc pump super structure 10 and be proximate to each of the first rail conduit 16 and the second rail conduit 18 as desired for a particular application. In an alternative embodiment pairings or groupings of guide rods 54 may be disposed on either side of the double disc pump super structure 10 in any combination.

In an alternative embodiment as may be seen in FIG. 18, an exploded component view of the double disc pump super structure 10 is shown including the mantel block 32, discharge coupler 64, renewable valve seat 44, intermediate housing 50, disc 46, inlet suction housing 48, suction flapper clack valve 42, replaceable valve seat 40, swan neck elbow 66 and suction coupler 62 as positioned relative to each other.

In a first embodiment, a induced flow reciprocating double disc pump assembly includes a substantially rectangular rotating frame element supporting a double disc pump super structure, the rotating frame element having a plurality of frame bars engaged to a plurality of support bars and a plurality of rail conduits engaged to the support bars, at least two of the plurality of frame bars having a shaft defining a horizontal axis of rotation, the shaft having a plurality of pairs of shaft positioning openings; a stationary frame element having a plurality of base frame bars, a plurality of uprights engaged to and extending vertically from the base frame bars, a plurality of diagonal braces engaged to the plurality of base frame bars and the plurality of uprights, and a flange bearing assembly engaged to an upper portion of each of the plurality of uprights, each of the flange bearing assemblies rotatably receiving the shaft, each of the flange bearing assemblies having a plurality of pairs of positioning holes; a locking pin being constructed and arranged for engagement to one of the pairs of shaft positioning openings aligned with one of the pairs of positioning holes; and a rotation crank engaged to the shaft; wherein the rotating frame element has a first position relative to the stationary frame element which is constructed and arranged to support the double disc pump super structure in a vertical direction, and the rotating frame element has a second position relative to the stationary frame element which is constructed and arranged to support the double disc pump super structure in a horizontal direction which is ninety degrees offset relative to the vertical direction, and wherein the rotation crank is constructed and arranged to rotate the rotating frame element between the first position and the second position.

In a second alternative embodiment according to the first embodiment, the double disc pump super structure has an underside and a plurality of guide rods engaged to the underside.

In a third alternative embodiment according to the second embodiment, the double disc pump super structure has an inlet suction housing and an intermediate housing, the plurality of guide rods being engaged to the double disc pump super structure, the inlet suction housing and the intermediate housing.

In a fourth alternative embodiment according to the third embodiment, the inlet suction housing and the intermediate housing are slidably engaged to the plurality of guide rods during assembly or disassembly relative to the double disc pump super structure when the rotating frame element is in the second position.

In a fifth alternative embodiment according to the fourth embodiment, a replaceable valve seat is positioned between a swan neck elbow and a suction flapper clack valve, the replaceable valve seat being formed of stainless steel.

In a sixth alternative embodiment according to the fifth embodiment, a circular and dished shaped renewable valve seat is positioned between the inlet suction housing and a disc, the renewable valve seat being formed of stainless steel.

In a seventh alternative embodiment according to the sixth embodiment, a mantel block is disposed between and secured to the underside and the plurality of rail conduits.

In an eighth alternative embodiment according to the seventh embodiment, the guide rods are engaged to the mantel block.

In a ninth alternative embodiment according to the eighth embodiment, the plurality of frame bars include a first perpendicular frame bar and a second perpendicular frame bar, the shaft being two opposite aligned shaft portions, wherein each of the two opposite aligned shaft portions is centrally positioned and extends outwardly from one of the first perpendicular frame bar and the second perpendicular frame bar.

In a tenth alternative embodiment according to the ninth embodiment, the plurality of support bars include a first vertical support bar, a second vertical support bar, a third vertical support bar, and a fourth vertical support bar.

In an eleventh alternative embodiment according to the tenth embodiment, the plurality of rail conduits include a first rail conduit and a second rail conduit.

In a twelfth alternative embodiment according to the eleventh embodiment, the plurality of base frame bars include a first base frame bar, a second base frame bar, a third base frame bar and a fourth base frame bar.

In a thirteenth alternative embodiment according to the twelfth embodiment, the plurality of uprights include a first upright and a second upright.

In a fourteenth alternative embodiment according to the thirteenth embodiment, the plurality of diagonal braces include a first diagonal brace, a second diagonal brace, a third diagonal brace and a fourth diagonal brace.

In a fifteenth alternative embodiment according to the fourteenth embodiment, a cross brace bar extends between the first upright and the second upright opposite to the flange bearing assemblies.

In a sixteenth alternative embodiment according to the fifteenth embodiment, the flange bearing assemblies including a first flange bearing assembly and a second flange bearing assembly.

While the foregoing is a description of the preferred embodiments for carrying out the invention for the purposes of complying with 37 C.F.R. 1.72., it is also intended in an illustrative rather than a restrictive sense. Variations to the exact embodiment described may be apparent to those skilled in such equipment without departing from the spirit and scope of the invention as defined by the claims set out below.

This completes the description of the preferred and alternate embodiments of the invention. Those skilled in the art may recognize other equivalents to the specific embodiment described herein which equivalents are intended to be encompassed by the claims attached hereto.

The above disclosure is intended to be illustrative and not exhaustive. This description will suggest many variations and alternatives to one of ordinary skill in this art. The various elements shown in the individual figures and described above may be combined or modified for combination as desired. All these alternatives and variations are intended to be included within the scope of the claims where the term "comprising" means "including, but not limited to".

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

I claim:

1. An induced flow reciprocating double disc pump assembly comprising:

a substantially rectangular rotating frame element supporting a double disc pump super structure, the rotating frame element having a plurality of frame bars engaged to a plurality of support bars and a plurality of rail conduits engaged to said support bars, at least two of said plurality of frame bars having a shaft defining a horizontal axis of rotation, each of said shafts having a plurality of pairs of shaft positioning openings, and each of said shafts being disposed centrally relative to said at least two of said plurality of frame bars;

a stationary frame element having a plurality of base frame bars, a plurality of uprights engaged to and extending vertically from said base frame bars, a plurality of diagonal braces engaged to said plurality of base frame bars and said plurality of uprights, and a flange bearing assembly engaged to an upper portion of each of said plurality of uprights, each of said flange bearing assemblies rotatably receiving one of said shafts, each of said flange bearing assemblies having a plurality of pairs of positioning holes;

a locking pin being constructed and arranged for engagement to one of said pairs of shaft positioning openings aligned with one of said pairs of positioning holes;

a rotation crank engaged to at least one of said shafts;

wherein said rotating frame element has a first position relative to said stationary frame element which is constructed and arranged to support said double disc pump super structure in a vertical direction, and said rotating frame element has a second position relative to said stationary frame element which is constructed and arranged to support said double disc pump super structure in a horizontal direction which is ninety degrees offset relative to said vertical direction, and wherein said rotation crank is constructed and arranged to rotate said rotating frame element between said first position and said second position; and said double disc pump super structure having an underside, an inlet suction housing, and an intermediate housing and a plurality of guide rods releasably engaged to said underside, wherein said inlet suction housing and said intermediate housing are slidably supported by said plurality of guide rods during assembly or disassembly relative to said double disc pump super structure when said rotating frame element is in said second position.

2. The induced flow reciprocating double disc pump assembly according to claim 1, further comprising a replaceable valve seat positioned between a swan neck elbow and a suction flapper clack valve, said replaceable valve seat being formed of stainless steel.

3. The induced flow reciprocating double disc pump assembly according to claim 2, further comprising a circular and dished shaped renewable valve seat positioned between said inlet suction housing and a disc, said renewable valve seat being formed of stainless steel.

4. The induced flow reciprocating double disc pump assembly according to claim 1, further comprising a cross brace bar extending between said first upright and said second upright proximate to said plurality of base frame bars.

5. The induced flow reciprocating double disc pump assembly according to claim 4, further comprising a mantel block disposed between and secured to said underside and said plurality of rail conduits.

6. The induced flow reciprocating double disc pump assembly according to claim 5, said guide rods being engaged to said mantel block.

7. The induced flow reciprocating double disc pump assembly according to claim 6, wherein said plurality of frame bars include a first perpendicular frame bar and a second perpendicular frame bar, wherein each of said shafts is centrally positioned and extends outwardly from one of said first perpendicular frame bar and said second perpendicular frame bar.

8. The induced flow reciprocating double disc pump assembly according to claim 7, wherein said plurality of support bars include a first vertical support bar, a second vertical support bar, a third vertical support bar, and a fourth vertical support bar.

9. The induced flow reciprocating double disc pump assembly according to claim 8, wherein said plurality of rail conduits include a first rail conduit and a second rail conduit.

10. The induced flow reciprocating double disc pump assembly according to claim 9, wherein said plurality of base frame bars include a first base frame bar, a second base frame bar, a third base frame bar and a fourth base frame bar.

11. The induced flow reciprocating double disc pump assembly according to claim 10, wherein said plurality of uprights include a first upright and a second upright.

12. The induced flow reciprocating double disc pump assembly according to claim 11, wherein said plurality of diagonal braces include a first diagonal brace, a second diagonal brace, a third diagonal brace and a fourth diagonal brace.

13. The induced flow reciprocating double disc pump assembly according to claim 11, said flange bearing assemblies including a first flange bearing assembly and a second flange bearing assembly.

14. An induced flow reciprocating double disc pump assembly comprising:

a substantially rectangular rotating frame element supporting a double disc pump super structure, the rotating frame element having a plurality of frame bars engaged to a plurality of support bars and a plurality of rail conduits engaged to said support bars, at least two of said plurality of frame bars having a shaft defining a horizontal axis of rotation, each of said shafts having a plurality of pairs of shaft positioning openings;

a stationary frame element having a plurality of base frame bars, a plurality of uprights engaged to and extending vertically from said base frame bars, a plurality of diagonal braces engaged to said plurality of base frame bars and said plurality of uprights, and a flange bearing assembly engaged to an upper portion of each of said plurality of uprights, each of said flange bearing assemblies rotatably receiving one of said shafts, each of said flange bearing assemblies having a plurality of pairs of positioning holes;

a locking pin being constructed and arranged for engagement to one of said pairs of shaft positioning openings aligned with one of said pairs of positioning holes; and a rotation crank engaged to at least one of said shafts;

wherein said rotating frame element has a first position relative to said stationary frame element which is constructed and arranged to support said double disc pump super structure in a vertical direction, and said rotating frame element has a second position relative to said stationary frame element which is constructed and arranged to support said double disc pump super structure in a horizontal direction which is ninety degrees offset relative to said vertical direction, and wherein said rotation crank is constructed and arranged to rotate said rotating frame element between said first position and said second position;

said double disc pump super structure having an underside and a plurality of guide rods engaged to said underside and an inlet suction housing, and an intermediate housing, said plurality of guide rods being engaged to said double disc pump super structure, said inlet suction housing and said intermediate housing;

wherein said inlet suction housing and said intermediate housing are slidably engaged to said plurality of guide rods during assembly or disassembly relative to said double disc pump super structure when said rotating frame element is in said second position; and said induced flow reciprocating double disc pump assembly further comprising a replaceable valve seat positioned between a swan neck elbow and a suction flapper clack valve, said replaceable valve seat being formed of stainless steel and a circular and dished shaped renewable valve seat positioned between said inlet suction housing and a disc, said renewable valve seat being formed of stainless steel.

15. The induced flow reciprocating double disc pump assembly according to claim 14, further comprising a mantel block disposed between and secured to said underside and said plurality of rail conduits.

16. The induced flow reciprocating double disc pump assembly according to claim 15, said guide rods being engaged to said mantel block.

17. The induced flow reciprocating double disc pump assembly according to claim 16, further comprising a cross brace bar extending between said first upright and said second upright proximate to said plurality of base frame bars.

* * * * *